US011806736B2

(12) United States Patent
Gillest et al.

(10) Patent No.: US 11,806,736 B2
(45) Date of Patent: Nov. 7, 2023

(54) CONTINUOUS VERTICAL SPRAYING OF BODIES SUCH AS CANS

(71) Applicants: Kevin Michael Gillest, Arvada, CO (US); Michael W. Calahan, Arvada, CO (US); Jared Patrick Jones, Golden, CO (US); William Devere Jones, Arvada, CO (US)

(72) Inventors: Kevin Michael Gillest, Arvada, CO (US); Michael W. Calahan, Arvada, CO (US); Jared Patrick Jones, Golden, CO (US); William Devere Jones, Arvada, CO (US)

( * ) Notice: Subject to any disclaimer, the term of this patent is extended or adjusted under 35 U.S.C. 154(b) by 0 days.

(21) Appl. No.: 16/696,990

(22) Filed: Nov. 26, 2019

(65) Prior Publication Data

US 2020/0164394 A1 May 28, 2020

Related U.S. Application Data

(63) Continuation of application No. 15/858,292, filed on Dec. 29, 2017, now Pat. No. 10,518,285, which is a (Continued)

(51) Int. Cl.
*B05D 7/22* (2006.01)
*B05B 13/02* (2006.01)

(Continued)

(52) U.S. Cl.
CPC ..... *B05B 13/0228* (2013.01); *B05B 7/061* (2013.01); *B05B 13/0278* (2013.01);

(Continued)

(58) Field of Classification Search
CPC . B05B 13/0228; B05B 7/061; B05B 13/0278; B05B 13/0426; B05D 1/02;

(Continued)

(56) References Cited

U.S. PATENT DOCUMENTS

| | | | | |
|---|---|---|---|---|
| 1,185,889 | A * | 6/1916 | Eberhart | H01L 21/6715 118/313 |
| 2,103,270 | A | 12/1937 | Murch | |
| 2,435,931 | A | 2/1948 | Schweitzer | |
| 3,452,709 | A | 7/1969 | Hartmeister et al. | |
| 3,697,313 | A | 10/1972 | Stumphauzer et al. | |
| 3,745,953 | A | 7/1973 | Hurst | |
| 4,186,225 | A | 1/1980 | Smith et al. | |
| 4,233,932 | A | 11/1980 | Blakeslee | |

(Continued)

FOREIGN PATENT DOCUMENTS

EP 0568365 B1 4/1993

OTHER PUBLICATIONS

International Preliminary Reporton Patentability for PCT/US2015/049366, dated Mar. 14, 2017, 6 pages. (Year: 2017).*

*Primary Examiner* — William P Fletcher, III
(74) *Attorney, Agent, or Firm* — Craig W. Barber; Barber Legal

(57) ABSTRACT

A vertical internal coating machine is taught, which may be used with bodies such as cans (2 piece, 3 piece, draw, redraw) and including cylinders, containers and any similar body. In the machine cans or similar bodies are sprayed with the star wheel in continuous motion without stopping and starting. The machine teaches that a plurality of spray guns may be provided for each pocket of the star wheel. By means of the machine an improved line layout is devised which may eliminate the need to raise the bodies immediately prior to a necker by allowing the vertical can internal coating machine and internal bake oven to be disposed on any level of the facility, upper, lower, mezzanine, etc. In green aspects, the machine may use negative pressure cabinets/hoods and positive pressure tunnels to entrain volatile organic chemicals emitted by the spray guns and coated bodies and may send these VOCs to a VOC destruction device, such as an oven.

15 Claims, 23 Drawing Sheets

| | |
|---|---|
| modulate star wheel speed | step 200 |
| feed vertical cans to a coating machine having a continuously rotating horizontal star wheel having peripheral pockets thereon and an angular rotation speed | step 202 |
| provide multiple offset spray guns per pocket | step 204 |
| rotate spray guns with star wheel | step 206 |
| secure cans in the pockets while the star wheel continues to rotate without stopping, using vacuum assist | step 208 |
| spin cans within pockets | step 210 |
| spray cans in the pockets while the star wheel continues to rotate without stopping | step 212 |
| remove cans from the pockets while the star wheel continues to rotate without stopping using air pressure assist | step 214 |
| convey cans to an internal bake oven | step 216 |
| provide a negative pressure about the coating machine, entrain VOCs, send to internal bake oven | step 218 |
| provide a positive pressure about outfeed, entrain VOCs, send to internal bake oven | step 220 |

Related U.S. Application Data continuation of application No. 14/484,229, filed on Sep. 11, 2014, now Pat. No. 9,889,460.

(51) Int. Cl.
*B05B 13/04* (2006.01)
*B05B 7/06* (2006.01)

(52) U.S. Cl.
CPC ..... *B05B 13/0426* (2013.01); *B05D 7/225* (2013.01); *B05D 7/227* (2013.01)

(58) Field of Classification Search
CPC . B05D 7/14; B05D 7/16; B05D 7/227; B05D 7/222; B05D 2254/04; B05D 2254/06
See application file for complete search history.

(56) References Cited

U.S. PATENT DOCUMENTS

| | | | | |
|---|---|---|---|---|
| 4,246,300 | A | 1/1981 | Jensen | |
| 4,378,386 | A * | 3/1983 | Rehman | B05B 13/0627 118/314 |
| 4,605,351 | A | 8/1986 | Hatcher et al. | |
| 5,564,877 | A | 10/1996 | Hamilton | |
| 5,612,096 | A | 3/1997 | Mulder et al. | |
| 6,510,938 | B1 * | 1/2003 | Bowlin | B65G 47/1407 198/450 |
| 8,578,878 | B2 * | 11/2013 | Khoury | B05B 13/0609 118/668 |
| 2013/0228122 | A1 | 9/2013 | Sasaki et al. | |

* cited by examiner

Figure 14

| | |
|---|---|
| modulate star wheel speed | step 200 |
| feed vertical cans to a coating machine having a continuously rotating horizontal star wheel having peripheral pockets thereon and an angular rotation speed | step 202 |
| provide multiple offset spray guns per pocket | step 204 |
| rotate spray guns with star wheel | step 206 |
| secure cans in the pockets while the star wheel continues to rotate without stopping, using vacuum assist | step 208 |
| spin cans within pockets | step 210 |
| spray cans in the pockets while the star wheel continues to rotate without stopping | step 212 |
| remove cans from the pockets while the star wheel continues to rotate without stopping using air pressure assist | step 214 |
| convey cans to an internal bake oven | step 216 |
| provide a negative pressure about the coating machine, entrain VOCs, send to internal bake oven | step 218 |
| provide a positive pressure about outfeed, entrain VOCs, send to internal bake oven | step 220 |

CONTINUOUS VERTICAL SPRAYING OF BODIES SUCH AS CANS

RELATED APPLICATION(S)

This application claims the priority and benefit of previously filed U.S. patent application Ser. No. 14/484,229 now issued as U.S. Pat. No. 9,889,460 B2 having the same title, and inventors, filed on Sep. 11, 2014, and of previously filed and previously co-pending U.S. patent application Ser. No. 15/858,292 now issued as U.S. Pat. No. 10,518,285 B2, having the same title and inventors, the entirety of which are incorporated here by this reference.

FIELD OF THE INVENTION

The present invention relates to production of cans or similar bodies (two piece cans, three piece cans, draw or redraw, containers, cylinders, etc), which may be of any material including but not limited to steel, or aluminum, and in particular relates to internal coating of the inner surfaces of cans and similar bodies.

BACKGROUND

Production and coating of metal cans, such as steel or aluminum cans and other hollow cylindrical bodies is a highly mechanized operation involving numerous steps in a long process from the initial metal to the final, properly shaped and coated can. For purposes of this application, aluminum will be used as an exemplary material for cans, however, the invention is not so limited and the term aluminum may be understood to stand in for any customary metal for cans.

Coils of aluminum or steel or other materials are uncoiled from a roll and flattened, then fed through a cupping press which stamps/draws a cup of aluminum or steel material. This goes through a bodymaker press which pulls it upward into a distinctly can-like cup shape, then the bottom is indented, that is, formed into a pressure dome such as customarily seen on the bottom of aluminum and steel beverage cans, bottle containers or other containers. Many beverages sold in cans are carbonated and thus mildly or highly pressurized, the dome shape allows the can to retain its shape despite the pressure. Thereafter the edge of the can must be trimmed since the structure of aluminum or steel metal causes irregularity in the draw and iron process. Note that the D&I process is as follows for beverage and/or food cans: cupper, bodymaker & trim, wash & dryoff oven, decoration followed by decoration cure oven, internal can spray and internal can oven, necker/flanger (bottles may require extra operations at this point), and finally to the palletizer. Note also that most food cans do not get decoration (exterior labels being more common for food cans), so the process is slightly modified to spray, bake, spray, bake, and in use they are vacuum packed.

In the case of three piece cans, they are fed into a blank auto feeder, a welder, side stripper, and oven for curing the stripping, (necker, beader, flanger) and tester, and then the palletizer. This process also may have internal spraying of a coating into the inner surface followed by an oven, if these steps are required.

At this point in almost any type of can operation involving internal coating, the middle part of the can production and coating process begins, and it is this middle part which is of particular interest to understanding the present invention. An understanding of the present invention's benefits requires some understanding of the current bottle necks and operation conditions of the prior art in can production and coating.

The can production and coating facility may normally be laid out on two levels: an upper level and a lower level. The lower level may be ground level, the upper level may be a mezzanine, an upper story of the facility and so on. In practice, the cans must travel from production station to production station while moving up and down the levels.

A can conveyor may convey the cans, en masse, to a decorator machine for decoration. Such can conveyors may be of several types. In particular, some can conveyors may be "mass" can conveyors with many cans arranged to be carried in parallel, for example, something rather like a conveyor belt which is wide enough to carry a number of cans abreast. Other can conveyors can be single file conveyors with a single column of cans in motion. Yet other conveyors may use pins to carry the cans. Conveyors may also have rails to hold the cans in place.

Significantly, such conveyors may convey cans not just horizontally but vertically. Cans may feed through a chute downward, or they may be raised upward if they are placed on a conveyor which exerts a modest negative pressure against the bottom of the can, so that normal ambient air pressure pushes the can against the moving conveyor (this is often thought of as "sucking" the can to the conveyor so that the conveyor may even go straight up, vertically, with the can remaining in place on the vertical conveyor as it moves).

The decorator may be disposed upon the lower level of the facility, with the cans entering from above. The cans exit the decorator and by means of a pin chain or the like may be conveyed, possibly single file, to a pin oven. The pin oven will obviously cure the decorations, however, the pin over will also raise the cans so that they are somewhat elevated above the lower level, possibly as high as the upper level, when the cans depart the pin oven. They may at this point be single file, or in mass, or they may be single file and then conveyed thereafter in mass.

The cans will then descend to the lower level as they enter the horizontal can internal coating machine which is at the heart of the present invention. The cans as they descend leave the vertical orientation and instead feed into something very much like a chute. In the chute the cans lay on their sides, with their axes of symmetry horizontal. The horizontal can internal coating machine will coat the inner surface of the cans as they descend to it. At this point, the cans are of course open at one end but otherwise have their final shape, so the coating operation must occur through the open end of the can.

In the past, the coatings which could be applied to aluminum/steel/alloys at high speed had the disadvantage of slumping. That is, if the coating were applied as one might paint a wall, the coating would thin at the top end and thicken at the bottom end. This is extremely undesirable. Thus the cans were of necessity coated while the cans were in a horizontal position.

The horizontal can internal coating machine would accept the can coming out of the bottom of the conveyor/chute by receiving it into a pocket on the top of a star wheel. The star wheel is vertically oriented, that is, it rotates in a plane which is vertical. The pocket of the star wheel would be dimensioned and configured to receive the horizontal can. The pocket of the star wheel may also have a roller on the side to cause the can to begin rotating within the star wheel.

The star wheel itself is driven by an indexing gear box. The indexing gear box rotates the star wheel by a set angle, the angle equal to the angle between pockets of the star wheel. The indexing gear box then stops the star wheel, and the next can coming down the chute/conveyor may drop into the next pocket. The star wheel is advanced one more index position and stopped and another can drops in the top.

The original can has by this time advanced considerably around the star wheel. At an index position later than the top of the star wheel, it will pass beside a spray gun(s). The spray gun (or guns, two are known in the prior art) will coat the can as it sits in the momentarily motionless star wheel. The roller or similar device will be causing the can to rotate, so the motionless spray gun(s) will quickly coat the entire inner surface of the can. Some steel cans require a spray-bake-spray-bake process because of the products which will be packaged in the steel containers.

When the star wheel is advanced again, the coated can will index forward again by the same angle. In due course, it will move, stopping and starting, until it is on the lower side of the star wheel and gravity begins urging it to fall from the pocket. Devices may cause/assist removing the internally coated can from the star wheel.

Thus in practice, the cans' advance through the horizontal can internal coating machine is actually carried out in a stop-and-go manner, much like a traffic jam on a highway. Like a traffic jam, this places limits on the amount of traffic which can pass through the highway in a given amount of time. In practice, real world prior art horizontal can internal can coating machines can achieve only about 300 to 350 cans per minute (cpm) in internal coating speed of the machine. This is a significant limitation to the can production and coating process.

One obvious way to circumvent this process limitation is to use several horizontal can internal coating machines in parallel, so the facility is likely to be laid out with a number of internal coating machines on the floor of the facility in a row. Each machine will have an individual conveyor/chute descending to it from above carrying an individual row of cans for the machine. From the row of machines, the cans are conveyed horizontally and in mass on the ground floor to an internal bake oven so that the internal coating may be baked.

Emerging from the internal bake oven, the cans are conveyed in mass on a vacuum elevator such as mentioned previously, and the cans are raised in mass to a higher level, possibly as high as the upper level of the facility. Logic would suggest that this is to be taken to another station in the production process which is located on the upper level. However in point of fact, the cans must simply be fed vertically downward to the next step in the process, the necker, rather in the same manner in which they had to be fed vertically downward to the horizontal internal coating machine.

Thus the cans emerge from the internal bake oven, are raised, nothing is done to them at the higher level, and then they are lowered back to the ground level to go to the necker. The vacuum elevator or similar conveyor device is thus needed simply in order to feed the necker properly.

The later steps in the process may then be carried out from the necking forward. The can may be flanged, inspected, and palletized open ended. The beverage/food maker's facility may be the site of filling and seaming of the lid onto the can.

Turning to FIG. 1A, an exemplary PRIOR ART star wheel and horizontal can internal coating machine may be seen. Star wheel 902 accepts can 904 as it is descending (arrow 910 showing descent from a high level, a mezzanine, upper story, etc). The stop-and-go motion of star wheel 902 is depicted by broken arrow 908. When the star wheel 902 rotates by one position and stops, spray gun 906 may spray the stationary can beside it.

FIG. 1B shows the exemplary PRIOR ART from the side, showing that the plane of rotation of star wheel 902 is in fact vertical. Spray gun 906 may be seen to be spraying 914 can 904 as can 904 sits stationary on the momentarily stationary star wheel 902.

FIG. 1C also shows this PRIOR ART device in a limited isometric view. Obviously, there is a time requirement for the spraying to occur. While this time may be fairly short (for example a few hundred milliseconds or less) it is obvious that the can rotate in one place, within the pocket of the star wheel, while the star wheel itself must sit still so that the body may be sprayed for that duration. Then the star wheel must spin by one index position, taking further time. The end result is that a prior art device, as discussed previously, can achieve a coating capacity of at most around 300 to 350 cans per minute under optimal conditions.

FIG. 2 shows the PRIOR ART production and coating facility, at least through the middle stage. As can be seen, there are two levels 920 and 922. Pin oven 924 raises the cans to the upper level 922, after which they are lowered again via chutes/conveyors 926 down to the horizontal can internal coating machine 928 which as can be seen has a vertical star wheel processing the cans. At the new lower level, the cans are conveyed and raised as necessary to the internal bake oven 936 to bake the internal coating just applied. The cans then are raised from the internal bake oven 936 by means of a vacuum or similar elevator previously discussed (not shown). This piece of equipment is present simply in order to raise the cans so that they can then be lowered into necker 934 where they receive their necking and flanging process.

One final issue faced by such facilities is the emission of volatile organic compounds by the horizontal can internal coating machine and by the coatings themselves after they have been applied but before the cans are baked and the coatings solidified. This occurs on the conveyor which runs from the horizontal can internal coating machine to the internal bake oven.

Turning now to more specific and detailed prior art, U.S. Pat. No. 2,103,270, "CAN SPRAYING MACHINE", in the name Murch, dated Dec. 28, 1937, teaches this horizontal internal coating machine. Obviously the machine is spraying cans which are horizontal, while the plane of rotation of the star wheel 11/12 is vertical. The cans "a" must descend chute 16/17 to reach the stationary first index position (marked by can "A"), before rotating to index position (marked by "B") and then sitting still again, and so on around until they may depart by chute 125. The process is clearly vertical so that the cans may be horizontal.

The machine of the Murch disclosure does teach that the interior of a horizontally disposed can or container can be sprayed or coated in a manner building up the final coating in stages and/or on different sections of the inner surfaces to that an even and unbroken coating results, despite the tendency of the coating to slump. At that time, filing in 1934, cans were normally of materials other than aluminum.

By the late 1950's, cans for beer had been known and the Adolf Coors Company first put beer into an aluminum can rather than a steel can or the like. This proved to be immensely popular and other companies followed, developing the pull tab top and other refinements.

One Coors patent is in the name of Hartmeister et al, dated Jul. 1, 1969, U.S. Pat. No. 3,452,709 for "MACHINE FOR COATING INTERIOR OF CONTAINERS". This device shows horizontally oriented cans 28 sliding down chute 29 to star wheel 15. Star wheel 15 is seen to be rotating and can 27' (one index position after the top) is seen to be counterrotating due to frictional engagement. Once again, the star wheel is seen to be vertical in order to provide horizontal pockets so that the rotating cans can be held horizontally.

This patent relates to a machine for coating interior surfaces of metal cans with lacquer and/or other protective coatings. The machine is particularly adapted for coating the interior surfaces of fragile cans (such as aluminum cans) without damage to the cans.

U.S. Pat. No. 3,697,313 issued in the name of Nordson for "METHOD OF SPRAYING CLOSED END CANS" (Oct. 10, 1972), taught that a can could be spun while a stationary spray gun sprayed into it. By spinning the can, an asymmetrical pattern could nonetheless coat the entire can interior.

U.S. Pat. No. 4,186,225 in the name of Smith et al for "METHOD OF COATING THE INTERIOR SURFACES OF A HOLLOW ARTICLE" (Jan. 29, 1980), teaches a two layer spraying technique in which there is no intervening drying or baking step, the second layer is thus applied wet onto the still wet first layer. Once again, this patent teaches spinning of the can (1000 to 3000 RPM), the use of stationary spray guns, and so on.

U.S. Pat. No. 4,233,932 in the name of Blakeslee issued Nov. 18, 1980 for "CONTROLLED DISPERSION OF COATINGS" teaches that the sprayer nozzle might spin, that is, spin on the axis of the spray gun nozzle itself. It does not teach that the gun may move on a spinning turret.

U.S. Pat. No. 5,246,300 issued to Jensen on Jan. 20, 1981 for "CAN TRANSPORT" once again shows a vertically oriented star wheel designed to hold cans horizontally, that is, another horizontal coating machine. The cans drop in to the star wheel from a chute coming down from above, and fall from the star wheel at the bottom.

EP 0568365 B1, Sep. 18, 1996 (filing Apr. 29, 1993) for INSTALLATION AND PROCESS FOR CLEANING A SPRAY NOZZLE, in the name of Wayru et al (a Nordson patent) points out another problem with can interior coating machines. The nozzles of spray guns become fouled with use, in particular, the nozzles become fouled due to periods of interrupted use. If a nozzle is used to spray a can interior and then the nozzle is unused for a short time while a star wheel rotates a new can underneath, the nozzle becomes fouled more quickly than if the nozzle is used continuously or in longer time segments.

It would be preferable to provide a novel and nonobvious design which allows can production to exceed, even dramatically exceed, the present day practical limit of around 300-350 CPM imposed by the start-stop nature of the spray process.

It would be desirable to provide a method of allowing spray guns to spray longer into each can, without slowing down production.

It would further be desirable to provide a method of reducing the number of can coating machines required on a production line.

It would yet further be desirable to provide an improved facility layout which minimized the number of times cans must be moved from a lower level to an upper level and vice-versa, thus reducing the number of conveyors, vacuum conveyors and the like which the line required.

All these advantages and more may be attained by means of the present invention, which is described in greater detail below and illustrated in the accompanying diagrams,

SUMMARY OF THE INVENTION

The present invention teaches providing a vertical interior coating machine which sprays the interior of a body such as a can of any type or process, container, a cylinder or other similar body, which is oriented vertically. Doing vertical spraying implicates the use of a coating formulation which will not slump. The improved machine has a star wheel which is oriented in a horizontal plane of rotation rather than a vertical plane of rotation. The pockets of the horizontal star wheel thus hold cans therein in a vertical orientation. This in turn means that the cans may enter the machine horizontally or nearly horizontally, from the side rather than from a higher story, mezzanine, or other raised area.

In addition, the present invention teaches that product speeds vastly exceeding 300-350 cans per minute may be attained by providing a turret above the star wheel, the turret having a plurality of spray guns thereon spraying each can in each pocket simultaneously and without the necessity for the stop-and-go motion of older machines. By this means the star wheel may be in continuous motion, the spray guns may achieve a higher percentage of time spent spraying rather than waiting for the star wheel, and output can be doubled or more than doubled per machine.

Furthermore, the present invention teaches that multiple guns may be used: rather than one or two spray guns in a stationary configuration (see FIG. 1A), the present invention teaches a plurality of spray guns for each pocket of the star wheel, and a larger star wheel with more pockets. Thus a single machine may have in one presently preferred embodiment and best mode contemplated at this time eight pockets and sixteen spray guns.

In yet another embodiment of the invention, an improved facility layout is taught. It will be understood that the facilities used at this time require a number of vertical raisings and lowerings of the cans as they are conveyed from one production process to the next. For example, after exiting the internal bake oven a vacuum conveyor is frequently employed to raise the cans up to a higher level simply in order to lower the cans down into the necker machine. The present invention teaches that the internal bake oven, fed by the vertical internal coating machine of the invention, may be on the upper level itself, thus eliminating the need to raise the cans before the necker and thus entirely eliminating the need for the vacuum conveyor after the internal bake oven. This eliminated item of machinery is not simply transferred forward in the line to another location: the need for that particular item is entirely removed, other pre-existing items which raise the cans (pin overs, etc) still raise the cans but now the cans remained elevated until the necker.

In a green aspect of the invention, protection of the ambient environment and reduction in emissions is provided by immediate burning of volatile organic compounds emitted by the coatings during the process of spraying and while the cans are not yet baked. These emissions can occur due to overspray, due to dispersion, and due to emission by the wet coating as it moves on the conveyor from the vertical can internal coating machine to the internal bake oven. The present invention teaches that the vertical can internal coating machine may be provided with a negative pressure hood to entrain the VOCs from the spraying and the conveyor may be provided with a positive pressure tunnel to entrain the VOCs from the coated cans. The air (possibly ambient air pushed by pressure into the cabinet/tunnel) is then fed through a VOC destruction device, where it is destroyed. One example of a VOC destruction device is the internal bake oven or another oven in which the VOC molecules are destroyed.

It is another aspect and advantage of the present invention to allow quick switching from production of one type of body to another type of body having different axial length and diameter by use of a controller which controls the spray gun mounts in particular, but which also controls other parameters of operation. This may reduce the need to switch out parts between different types of products for various production runs.

If is yet a further aspect and advantage of the invention to keep the spray guns operating for longer periods of time. It is an observed fact of spray gun usage that the stopping and starting which is used in the older reference designs of IC machine leads to more fouling of the spray guns. The present invention reduces stopping and starting and increases spray time, thus reducing the need for maintenance.

These, and other, embodiments of the invention will be better appreciated and understood when considered in conjunction with the following description and the accompanying drawings. It should be understood, however, that the following description, while indicating various embodiments of the invention and numerous specific details thereof, is given by way of illustration and not of limitation. Many substitutions, modifications, additions and/or rearrangements may be made within the scope of the invention without departing from the spirit thereof, and the invention includes all such substitutions, modifications, additions and/or rearrangements.

SUMMARY IN REFERENCE TO THE CLAIMS

It is thus one advantage, aspect, objective and embodiment of the present invention to provide a machine for coating the inner surface of a plurality of cylindrical bodies, each of the cylindrical bodies having an open end, one closed end, and an axis and a diameter, the machine comprising:

a rotating star wheel having a periphery and a plurality of pockets in the periphery, the star wheel having a plane of rotation and an angular speed of rotation, the star wheel operative in a first mode of rotation to rotate continuously without indexing motion, the star wheel having under each of the plurality of pockets one of a plurality of chucks, each of the plurality of chucks dimensioned and configured to accept thereon one such cylindrical body closed end, each of the pockets cooperating with the chuck thereunder to secure such cylindrical body therein, a plurality of spray guns, each of the pockets having a first spray gun associated therewith, the first spray gun oriented so as to spray into such open end of such cylindrical body, the first spray gun associated with each of the pockets rotating with the pocket at the angular speed of rotation of the star wheel, a controller operatively connected to each of the plurality of spray guns, the controller directing each of the plurality of spray guns to spray continuously into such cylindrical body while the star wheel is simultaneously rotating, whereby such cylindrical body may be sprayed while in motion in the pocket of the star wheel.

It is thus another advantage, aspect, objective and embodiment of the present invention to provide a machine further comprising:

a second spray gun associated with each of the pockets of the star wheel, the second spray gun also oriented so as to spray into the same such open end of such cylindrical body, the second spray gun associated with each of the pockets rotating with the pocket at the angular speed of rotation of the star wheel, whereby such cylindrical body may be sprayed from two spray guns simultaneously while in motion rotating in the pocket of the star wheel.

It is thus another advantage, aspect, objective and embodiment of the present invention to provide a machine wherein the star wheel is oriented with its plane of rotation horizontal, and further wherein such cylindrical body is oriented with its axis vertical, whereby such cylindrical body is sprayed while in a vertical orientation.

It is thus another advantage, aspect, objective and embodiment of the present invention to provide a machine wherein the star wheel is oriented with its plane of rotation vertical, and further wherein such cylindrical body is oriented with its axis horizontal, whereby such cylindrical body is sprayed while in a horizontal orientation.

It is thus another advantage, aspect, objective and embodiment of the present invention to provide a machine wherein the controller is operative to select the angular speed of rotation of the star wheel and the plurality of spray guns associated with the pockets of the star wheel, the controller operative to select between at least a first angular speed of rotation from the range spanning 1 to 300 RPM, and a second angular speed of rotation from the range of angular speeds of rotation in excess of 100 RPM.

It is thus another advantage, aspect, objective and embodiment of the present invention to provide a machine wherein such cylindrical body is held in the pocket of the star wheel for at least 270 degrees of rotation of the star wheel.

It is thus another advantage, aspect, objective and embodiment of the present invention to provide a machine wherein such cylindrical body is sprayed while the star wheel is in motion for at least 90 degrees of rotation of the star wheel.

It is thus another advantage, aspect, objective and embodiment of the present invention to provide a machine wherein each of the plurality of chucks spin in relation to the pocket while the star wheel rotates.

It is thus another advantage, aspect, objective and embodiment of the present invention to provide a machine wherein each of the plurality of chucks is operative to provide a vacuum or other methods to such closed end of such cylindrical body, thereby assisting the securing of such cylindrical body in the pocket.

It is thus another advantage, aspect, objective and embodiment of the present invention to provide a machine wherein each of the plurality of chucks is operative to provide a puff of air or other methods to such cylindrical body in order to remove such cylindrical body from the chuck.

It is thus another advantage, aspect, objective and embodiment of the present invention to provide a machine further comprising:

a spray gun mount associated with each of the first spray guns, the spray gun mount operative to provide three axis alignment in translation and at least one axis alignment in rotation, whereby the first spray gun and the second spray gun may be offset from one another, whereby the first and second spray guns spray two different parts of such inner surface of such cylindrical body.

It is thus another advantage, aspect, objective and embodiment of the present invention to provide a machine wherein the star wheel further comprises:

at least six pockets, preferably at least eight pockets.

It is thus another advantage, aspect, objective and embodiment of the present invention to provide a machine further comprising:

an infeed conveyor line, the infeed conveyor line having a slope providing a gravity feed for such cylindrical body to ride to the star wheel, such cylindrical body oriented vertically upon the infeed conveyor line, and an outfeed conveyor line, the outfeed conveyor line horizontal.

It is thus another advantage, aspect, objective and embodiment of the present invention to provide a machine wherein the sloped infeed conveyor line has a total vertical drop of less than 18 inches.

It is thus another advantage, aspect, objective and embodiment of the present invention to provide a machine further comprising:

an out feed conveyor line, the outfeed conveyor line having a slope providing a gravity removal for such cylindrical body to ride from the star wheel, such cylindrical body axis oriented vertically upon the outfeed conveyor line, and an infeed conveyor line, the infeed conveyor line horizontal.

It is thus another advantage, aspect, objective and embodiment of the present invention to provide a machine wherein the sloped outfeed conveyor line has a total vertical drop of less than 18 inches.

It is thus another advantage, aspect, objective and embodiment of the present invention to provide a machine further comprising:

a negative pressure cabinet substantially surrounding the machine, the negative pressure cabinet exhausting volatile organic compounds to a VOC destruction device or an oven.

It is thus another advantage, aspect, objective and embodiment of the present invention to provide a machine further comprising:

a positive pressure tunnel substantially surrounding the outfeed, the positive pressure tunnel exhausting volatile organic compounds to a VOC destruction device or an oven.

It is thus yet another advantage, aspect, objective and embodiment of the present invention to provide a machine for coating the inner surface of a plurality of cylindrical bodies, each of the cylindrical bodies having an open end, one closed end, and an axis and a diameter, the machine comprising:

a rotating star wheel having a periphery and a plurality of pockets in the periphery, the star wheel having under each of the plurality of pockets one of a plurality of chucks, each of the plurality of chucks dimensioned and configured to accept thereon one such cylindrical body closed end, each of the pockets cooperating with the chuck thereunder to secure such cylindrical body therein, a plurality of spray guns, each of the pockets having a first and a second spray gun associated therewith, the first and second spray guns oriented so as to spray into such open end of such cylindrical body, the first and second spray guns associated with each of the pockets rotating with the pocket at the angular speed of rotation of the star wheel, a controller operatively connected to the spray guns, the controller directing each of the first and second spray guns to spray into such cylindrical body, whereby such cylindrical body may be sprayed by two guns simultaneously.

It is thus yet another advantage, aspect, objective and embodiment of the present invention to provide a machine further comprising:

the star wheel having a plane of rotation and an angular speed of rotation, the star wheel operative in a first mode of rotation to rotate continuously without indexing motion, the controller directing each of the first and second spray guns to spray while the star wheel is simultaneously rotating, whereby such cylindrical body may be sprayed while in motion in the pocket of the star wheel.

It is thus yet another advantage, aspect, objective and embodiment of the present invention to provide a machine wherein the star wheel is oriented with its plane of rotation horizontal, and further wherein such cylindrical body is oriented with its axis vertical, whereby such cylindrical body is sprayed while in a vertical orientation.

It is thus yet another advantage, aspect, objective and embodiment of the present invention to provide a machine for coating the inner surface of a plurality of cylindrical bodies, each of the cylindrical bodies having an open end, one closed end, and an axis and a diameter, the machine comprising:

a rotating star wheel having a periphery and a plurality of pockets in the periphery, the star wheel having a plane of rotation and an angular speed of rotation, the star wheel oriented with its plane of rotation horizontal, the star wheel having under each of the plurality of pockets one of a plurality of chucks, each of the plurality of chucks dimensioned and configured to accept thereon one such cylindrical body closed end, each of the pockets cooperating with the chuck thereunder to secure such cylindrical body therein, such cylindrical body axis oriented with its axis vertical, each of the pockets having a first spray gun associated therewith, the first spray gun oriented so as to spray into such open end of such cylindrical body, the first spray gun associated with each of the pockets rotating with the pocket at the angular speed of rotation of the star wheel, a controller operatively connected to each of the plurality of spray guns, whereby such cylindrical body is sprayed while in a vertical orientation.

It is thus yet another advantage, aspect, objective and embodiment of the present invention to provide a machine further comprising:

a second spray gun associated with each of the pockets of the star wheel, the second spray gun also oriented so as to spray into the same such open end of such cylindrical body, the second spray gun associated with each of the pockets rotating with the pocket at the angular speed of rotation of the star wheel, whereby such cylindrical body may be sprayed from two spray guns simultaneously while in motion in the pocket of the star wheel.

It is thus yet another advantage, aspect, objective and embodiment of the present invention to provide a machine wherein, and further wherein the star wheel is operative in a first mode of rotation to rotate continuously without indexing motion, and further wherein:

the controller directs each of the plurality of spray guns to spray continuously into such cylindrical body while the star wheel is simultaneously rotating, whereby such cylindrical body may be sprayed while in motion in the pocket of the star wheel.

It is thus yet another advantage, aspect, objective and embodiment of the present invention to provide a machine for coating the inner surface of a plurality of cylindrical bodies, each of the cylindrical bodies having an open end, a closed end, and an axis and a diameter, the machine comprising:

a rotating star wheel having a periphery and a plurality of pockets in the periphery, the pockets dimensioned and configured to accept therein one of such cylindrical bodies in an orientation with such cylindrical body axis vertical, the star wheel having a horizontal plane of rotation and an angular speed of rotation, the star wheel operative in a first mode of rotation to rotate continuously without indexing motion, a plurality of chucks, one chuck disposed under each of the plurality of pockets, each of the plurality of chucks dimensioned and configured to accept thereon one such cylindrical body closed end, each of the pockets cooperating with the chuck thereunder to secure such cylindrical body in a vertical orientation therein, each of the chucks operative to deliver a positive air pressure and a negative air pressure to such cylindrical body closed end, whereby each chuck may assist to secure and remove such cylindrical body from the chuck, each of the plurality of chucks spinning at a spin speed in relation to the pocket while the star wheel rotates, a turret, the turret arranged above the star wheel and rotating therewith at the angular speed of rotation of the star wheel, the turret having a plurality of arms, the number of arms equal to the number of pockets, each arm projecting to a position above a corresponding pocket, each arm having thereon a pair of spray gun mounts, each spray gun mount having thereon a spray gun, each of the spray gun mounts operative to provide three axis alignment in translation and at least one axis alignment in rotation, whereby each of the pockets has a first and second spray guns associated therewith, the first and second spray guns oriented so as to spray into such open end of such cylindrical body when such cylindrical body is secured with in the pocket, the first spray gun and the second spray gun offset from one another, whereby the first and second spray guns spray two different parts of such inner surface of such cylindrical body, an infeed conveyor line, such cylindrical body axis oriented vertically upon the infeed conveyor line, and an outfeed conveyor line, such cylindrical body axis oriented vertically upon the outfeed conveyor line, a negative pressure cabinet substantially surrounding the machine, the negative pressure cabinet drawing ambient air into itself, the moving ambient air entraining volatile organic compounds from the spray guns and a positive pressure tunnel substantially surrounding the outfeed, the positive pressure tunnel expelling ambient air, the expelled ambient air entraining volatile organic compounds emitted by such cylindrical body after spraying, the negative pressure cabinet and the positive pressure tunnel exhausting volatile organic compounds to a VOC destruction device;

a controller operatively connected to each of the plurality of spray guns, the controller directing each of the plurality of spray guns to spray continuously into such cylindrical body from a first time when such cylindrical body moves from the infeed into a pocket until a second time when such cylindrical body moves from the pocket to the outfeed while the star wheel is simultaneously rotating, whereby such cylindrical body inner surface may be sprayed while oriented vertically and while in motion in the pocket of the star wheel, the controller operatively connected to the star wheel, the controller selecting the angular speed of rotation of the star wheel and thus the angular speed of rotation of the turret, the controller operatively connected to the chucks, the controller selecting the spin speed of the chucks and thus the spin speed of such cylindrical body on the chucks.

It is thus yet another advantage, aspect, objective and embodiment of the present invention to provide a machine having at least 8 pockets and at least 16 spray guns.

It is thus yet another advantage, aspect, objective and embodiment of the present invention to provide a can coating and production facility for use with cans having an axis, the facility comprises:

a lower level and an upper level;

a pin oven releasing such cans onto a conveyer on the upper level;

a vertical can coating machine which coats such cans with such can axis oriented vertically, the vertical can coating machine having a horizontally oriented star wheel, the vertical can coating machine on the upper level;

an internal bake oven on the upper level, the cans from the vertical can coating machine conveyed to the internal bake oven;

a necker located on the lower level, the cans from the internal bake oven conveyed while being lowered to the necker.

It is thus yet another advantage, aspect, objective and embodiment of the present invention to provide a can coating and production facility further comprising:

a negative pressure cabinet substantially surrounding the vertical can coating machine, the negative pressure cabinet exhausting volatile organic compounds to the internal bake oven.

It is thus yet another advantage, aspect, objective and embodiment of the present invention to provide a can coating and production facility further comprising:

a positive pressure tunnel substantially surrounding such cans while they are conveyed to the internal bake oven, the positive pressure tunnel exhausting volatile organic compounds to the internal bake oven.

It is thus yet another advantage, aspect, objective and embodiment of the present invention to provide a can coating and production facility further comprising:

a plurality of devices on the star wheel assisting in securing such cans to the star wheel.

It is thus yet another advantage, aspect, objective and embodiment of the present invention to provide a can coating and production facility further comprising:

a plurality of devices on the star wheel assisting in removing such cans from the star wheel.

It is thus even yet another advantage, aspect, objective and embodiment of the present invention to provide a method of coating cans internally, for use with cans having an inner surface and an axis, the method consisting of the steps of:

feeding the cans to a coating machine having a continuously rotating star wheel having peripheral pockets thereon and an angular rotations speed, securing the cans in the pockets while the star wheel continues to rotate without stopping, spraying the cans in the pockets while the star wheel continues to rotate without stopping, removing the cans from the pockets while the star wheel continues to rotate without stopping, conveying the cans to an internal bake oven.

It is thus even yet another advantage, aspect, objective and embodiment of the present invention to provide a method further comprising the step of:

providing a plurality of spray guns associated with each pocket, rotating the spray guns without stopping at the angular rotation speed, whereby the spray guns remain in alignment with the pockets as the star wheel and spray guns rotate.

It is thus even yet another advantage, aspect, objective and embodiment of the present invention to provide a method further comprising:

rotating the star wheel in a horizontal plane and feeding, securing, spraying, removing and conveying such cans with such axes thereof vertically oriented.

It is thus even yet another advantage, aspect, objective and embodiment of the present invention to provide a method further comprising: modulating the star wheel and spray guns' rotation speed.

It is thus even yet another advantage, aspect, objective and embodiment of the present invention to provide a method further comprising:

spinning such cans within such pockets.

It is thus even yet another advantage, aspect, objective and embodiment of the present invention to provide a method further comprising:

rotating such cans at least 270 degrees about the star wheel between feeding such cans to the star wheel and removing such cans from the star wheel.

It is thus even yet another advantage, aspect, objective and embodiment of the present invention to provide a method further comprising:

spraying such cans for at least 90 degrees of the rotation of the star wheel.

It is thus even yet another advantage, aspect, objective and embodiment of the present invention to provide a method further comprising:

providing a device to assist securing such cans in such pockets.

It is thus even yet another advantage, aspect, objective and embodiment of the present invention to provide a method further comprising:

providing a device to assist in removing such cans from such pockets.

It is thus even yet another advantage, aspect, objective and embodiment of the present invention to provide a method further comprising:

offsetting a first of the spray guns associated with a first pocket from a second of the spray guns associated with the first pocket, whereby the first and second spray guns spray two different parts of such inner surface of such can.

It is thus even yet another advantage, aspect, objective and embodiment of the present invention to provide a method further comprising:

rotating the star wheel in a vertical plane and feeding, securing, spraying, removing and conveying such cans with such axes thereof horizontally oriented.

It is thus even yet another advantage, aspect, objective and embodiment of the present invention to provide a method wherein:

the star wheel comprises six or more pockets, preferably at least eight pockets.

It is thus even yet another advantage, aspect, objective and embodiment of the present invention to provide a method further comprising:

feeding the cans to the coating machine with their axes vertical on a horizontal infeed.

It is thus even yet another advantage, aspect, objective and embodiment of the present invention to provide a method further comprising:

removing the cans from the coating machine with their axes vertical on a horizontal outfeed.

It is thus even yet another advantage, aspect, objective and embodiment of the present invention to provide a method further comprising:

providing a negative pressure about the coating machine, whereby volatile organic compounds are entrained.

It is thus even yet another advantage, aspect, objective and embodiment of the present invention to provide a method further comprising:

sending the volatile organic compounds to a VOC destruction device or oven.

It is thus even yet another advantage, aspect, objective and embodiment of the present invention to provide a method further comprising:

Providing a positive pressure while conveying the cans to the internal bake oven, whereby volatile organic compounds are entrained and sent to an oven or a VOC destruction device.

It is thus even yet another advantage, aspect, objective and embodiment of the present invention to provide a method further comprising:

feeding the cans to the coating machine from a sloped infeed having a total drop of less than 18 inches.

It is thus even yet another advantage, aspect, objective and embodiment of the present invention to provide a method further comprising:

removing the cans from the coating machine using a sloped outfeed having a total drop of less than 18 inches.

INDEX TO THE REFERENCE NUMERALS

Star wheel 102
Periphery 104
Pocket 106
Chuck
Second spray gun 112
Turret 114
Controller 116
Arm 118
Mount 120
Air vent (positive/negative pressure) 122
Infeed 126
Infeed 126'
Mass infeed 127
Outfeed 128
Outfeed 128'
Mass outfeed 129
Negative pressure cabinet 130
Dirty air duct 132
Lover level/ground level 134
Upper level/mezzanine/15 feet 136
Pin oven 138
Vertical internal spray machine bank 140
Conveyor 142
Conveyor 144
Internal bake oven 146
Conveyor (descends) 148
Necker 150
Spray 152
Spray (second associated gun) 152'
Spray cycle angle 154
Can load/unload cycle angle 156
Positive pressure outfeed tunnel 158
Can securing device 160
Body (can) 300
Spray gun head 302
Extension 304

Spray coating 306
Axis (length) 308
Diameter 310

BRIEF DESCRIPTION OF THE DRAWINGS

FIG. 14 is a tabular flowchart of the steps of the method of the invention.

DETAILED DESCRIPTION OF EMBODIMENTS

Figure 1A:
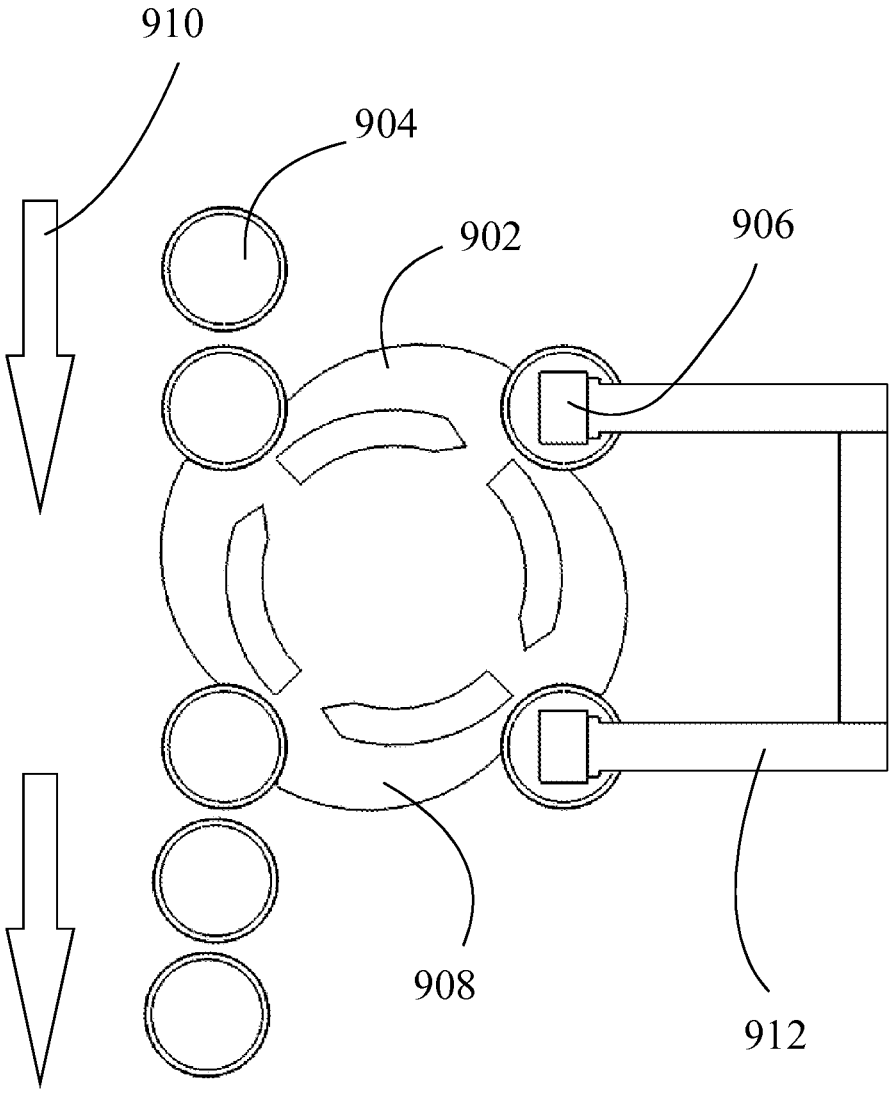
Figure 1A PRIOR ART
FIG. 1A is an isometric view of a PRIOR ART can coating machine, showing the horizontal orientation of the cans during the spraying operation, showing the fact that spraying only occurs at one or two stationary index locations on the star wheel, which slows down production immensely.
Figure 1B:
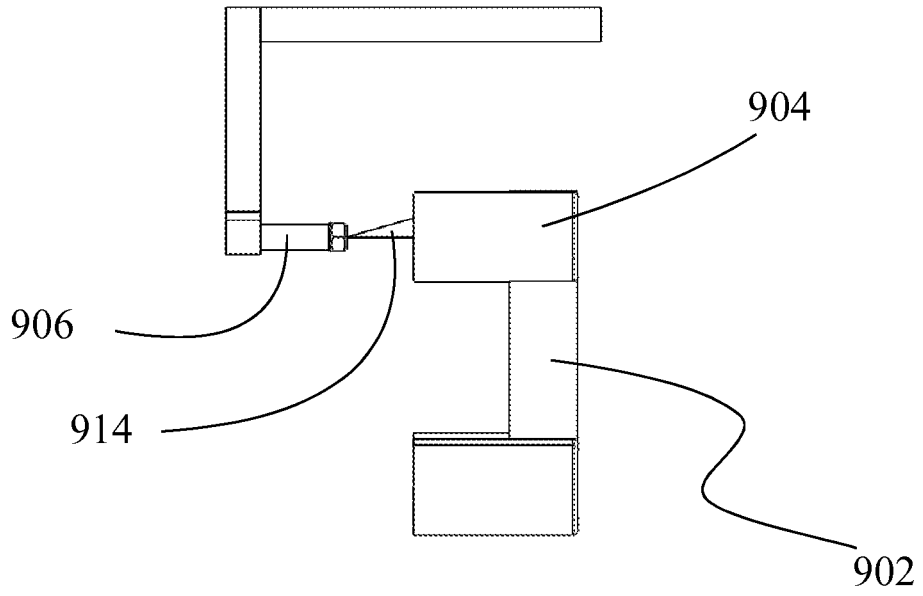
Figure 1B PRIOR ART
FIG. 1B is a right side view of a machine according to the PRIOR ART, showing the horizontal orientation of the cans and spray guns.
Figure 1C:
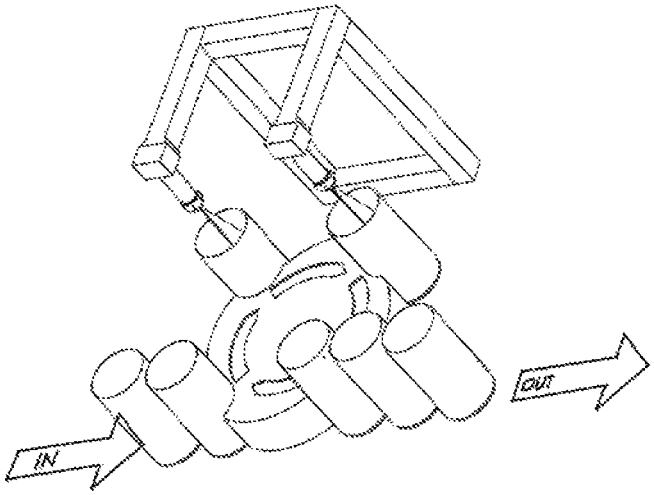
Figure 1C PRIOR ART
FIG. 1C is a front view of a machine according to the PRIOR ART.

A brief GLOSSARY of terminology used herein by the applicant(s) as his/their own lexicographer(s) is now presented.

Aluminum or steel as used herein merely refers to the base material for most cans. Other materials may be used, albeit in the case of many metals the manufacturing process is dissimilar. In addition, alloys of aluminum or steel are normal: an aluminum can for example may well be about 1% manganese and magnesium, with even smaller amounts of iron, copper, silicon and so on. For purposes of this application, aluminum will be used as an exemplary material for cans and cans will be understood to be an exemplary body for two piece cans, three piece cans, draw, redraw, cylinders, containers and similar bodies, however, the invention is not so limited and the term aluminum and the term can may be understood to stand in for any customary metal for similar bodies.

The device may also work on any cylindrical body having one open end, one closed end, or two open ends, and a diameter. Note that both cans and cylindrical bodies in general have an axis passing through the interior of the can from end to end, this is referred to as the axis, plural axes, herein. When the axis is vertical the can or cylindrical body is said to be vertical, this would be similar to the way a can would be held in the hand of an individual drinking from it, with the open end upward to prevent the contents from spilling. When the axis is horizontal the cylindrical body or can is said to be horizontal. Such cans/cylindrical bodies may have an inner surface, the inner surface may be assumed to be entire interior surface of the can: the inside of the bottom, the inside of the side walls, and so on. Such cylindrical bodies need not be cans. They need not be limited to beverage containers, and they need not be limited to aluminum alloy materials. Other examples, included merely to demonstrate the breadth, include food containers, general line, aerosol and monobloc containers, three piece containers, draw/redraw and so on and so forth. For purposes of this application the term "can" will be used to refer to any type of can-like body, including but not limited to cans (two piece, three piece, draw, redraw), other can-like containers, aerosol containers, cylinders, cylindrical bodies and so on and so forth, regardless of the material of manufacture or intended purpose.

The term rotating star wheel as used herein refers to a body of an only generally disk-like nature due to the periphery being indented with a plurality of pockets: these pockets are dimensioned and configured to accept a cylindrical body, for example, the chord of each pocket is large enough to accept the diameter of the cylindrical body/can.

The term plane of rotation of the star wheel refers to the plane in which the star wheel sits, rather than the axis of whatever the star wheel rotates upon: an axle, etc. Thus the plane of rotation of a horizontal star wheel means that the peripheral pockets are disposed so as to hold cans with the cans' axes vertical.

Chucks are disposed underneath pockets, in the plane of rotation of the star wheel. Chucks are objects which are dimensioned and configured to accept the shape and size of the bottom of the can: the closed end of the can will sit securely upon the chuck. Chucks may be disk-like, or other advantageous shapes. Chucks rotate themselves, that is, in addition to rotating with the associated pocket about the star wheel, each chuck rotates individually so as to impart a spin to the can sitting thereon. This spin may in embodiments be substantially faster than the star wheels' spin rate, may in embodiments perhaps even be ten times or more faster. This may be referred to as "spinning in relation to" something such as a pocket or star wheel. Chucks also have air vents therein which allow them to provide to the bottom of the can either negative or positive pressure. When negative pressure is provided, the can is pushed onto the chuck by the ambient air pressure on other parts of the can, this is commonly referred to as "sucking" by the chuck but in fact is pushing from above by the ambient air. When positive pressure is provided by the chuck, the can receives a "puff" of air which will tend to lift the can (which is of light weight) off the chuck, assisting removal of the can from the pocket. Other devices may be provided on chucks for securing or removing cans, for example, ridges can be seen on the exemplary chucks of the diagrams, the ridges may be dimensioned and configured to engage a can bottom. Clamps and the like may be used and so on. All of these may be referred to as devices for assisting in securing or removing cans.

For purposes of this application, the motion of the star wheel will generally be referred to as "rotation" while the motion of the chucks within the star wheel will be called "spinning".

Spray guns or lancing systems are made by a number of manufacturers. A spray gun or lancing system, nozzle, any type of spray nozzle, body, injector or equivalent structure refers to anything now known or later developed, regardless of brand, which sprays a liquid in the form of numerous extremely small droplets onto/into the interior of the cylindrical body/can.

The angular speed of rotation of the star wheel (and thus of the turret and spray guns above the star wheel and the chucks which may be a portion of the star wheel or located below it but rotating therewith) refers to the number of RPMs (revolutions per minute) or may refer to an angular measure such as degrees or radians per time interval of convenience. It may also be denominated in terms of the number of pockets moved in a given time frame, since pockets are evenly angularly spaced on the star wheel. This angular speed may be varied in embodiments of the invention. For example, older star wheels may move at a low speed due to their stop-spray-go motion, thus being limited to 60 or 80 RPM or less. The present invention may operate at any angular speed of rotation of convenience for spray times desired, number of pockets, and so on, and thus may also operate at such relatively low RPM or even slower. Unlike older star wheels however, the present invention may operate at higher rotation speeds, 90 RPM, 100 RPM or even higher: 200 RPM, 300 RPM and so on. It is also worth noting that the present invention accomplishes more can production per single rotation than older star wheel designs do. Thus a single rotation of the star wheel of the invention might coat twice as many cans or more compared to a single rotation of an older design.

Note that there is a substantial difference between the reference angular rotation of star wheels, which is stop-spray-go, once per can/pocket, and the continuous motion of the star wheel of the present invention.

A controller may be electronic or physical. Electronic controllers are used in the preferred embodiment and best mode now contemplated, as they may be produced cheaply, programmed quickly and very importantly, re-programmed for different needs. The controller may optionally control at least: the timing of spray initiation and stop for the spray guns and thus the length of time spraying, the speed of the star wheel, the individual rotation speed (spin) of the chucks and thus cans riding thereon, the speeds of conveyors and so on. It may control spray gun mounts and thus control where the spray guns spray, and even which spray guns are used at any given time. It may further control operation of the fans/pumps which provide positive and negative pressure to the chucks, and may in addition provide control operations of the fans/pumps which provide positive and negative pressures to the recycling cabinet and tunnel.

The controller may also be mechanical, though this is merely an optional alternative embodiment. Controllers having solenoids, cams, keys and so on may be used.

Controllers allow the device of the invention to quickly and easily switch from internal coating of a first type of body to a second type of body. Thus, the controller may have multiple modes of operation, for example, a first mode and a second mode of operation, each mode being optimized for coating the interior of a different type of body. The modes may have different times to begin and end spraying, spray parameters, angular rotation rates of the star wheel, spin of the chucks, use of vacuum and puffs of air for can securing and removal and so on and so forth. Virtually every parameter of the device may be preprogrammed for different units of production.

One area in particular is the control of the spray gun mounts, which may as noted be multiple axis, for example, one or axes in translation and up to three axes of rotation. By adjusting these mount parameters in accordance with either entered instructions, or preprogrammed instructions, the device may switch to new types of can/body production very quickly.

Spraying continuously into such cylindrical body/can refers to a spray gun rotating with a can around the star wheel, while the spray continues, rather than spraying at only a single index location per spray gun.

This may occur while the star wheel is simultaneously rotating, that is, the spray gun, can, star wheel, chuck, etc may rotate while spraying operations occur, dramatically shortening the time spent in the star wheel by each can/cylindrical body.

Continuous also refers to to the angular portion of the star wheel's motion which is spent in spraying. Thus a spray gun may spray for 270 degrees, 225 degrees, 90 degrees, etc, meaning the portion of the 360 degree rotation of the star wheel which is implicated in spraying.

The term "associated with" means that something such as a chuck or spray gun is rotating with a certain item such as a pocket, is pointed at that pocket and does not move in relation to that pocket or item.

A spray gun mount as used herein refers to a device capable of pointing a spray gun, and capable of being adjusted to point the spray gun (or any nozzle) in a new direction. In the present invention, the spray gun mount is not only sufficient to provide two translation dimension and one rotation dimension control of the nozzle/gun but also a third translation dimension and/or additional rotation dimensions. In particular, the mounts of the invention may allow two or more guns which are both/all associated with a particular pocket to be offset laterally from one another so that the spray from each gun does not interfere with the spray from the companion gun/s.

Infeed and outfeed refer to conveyors which carry cans/cylindrical bodies respectively to and from the vertical can internal coating machine of the invention. This conveyor may be a mass conveyor (having more than a single column of cans being conveyed) or a single file conveyor, or it may have rails, edges, a top, a tunnel, it may be vacuum or other devices and methods, it may be a belt or solid plastic or wheeled or a walking floor design and so on, without limitation.

Various vertical drops may be seen in the prior art, for example a vertical drop of 15 feet (4.5 meters) from a higher level to an older horizontal can internal coating machine. The present invention teaches that a vertical drop may be used which is as small as a few inches (centimeters) up to a mere 18 inches (0.45 m). The present invention further teaches that whereas older vertical drops were substantially vertical, a drop may now be a gentle slope of 45 degrees or even less. A negative pressure cabinet may offer complete enclosure, rather like a storage cabinet might, or it may have large vents to allow the entry of ambient air, it may have less than six sides, more than six sides, and it may be a hood. Pressure inside may be maintained at least slightly below ambient air pressure so that ambient air is "sucked" (pushed by ambient pressure) into the cabinet and airborne pollutants, specifically VOCs, may not easily leave the cabinet except entrained with the air as it is vented away to a VOC destruction device such as an oven.

As used herein, a VOC destruction device includes an oven, such as the internal bake oven, the pin oven or the like, but may include scrubbers, precipitators, burners, reactors, sprayers, electrical devices and the like.

A positive pressure tunnel is a system having an open front end into which both ambient air and cans are brought while cans are conveyed from the vertical can internal coating machine of the invention to the internal bake oven. A slight overpressure is maintained in the tunnel so that air within the tunnel is expelled into the internal bake oven, with airborne pollutants (VOCs) entrained.

Substantially surrounded by a pressure device such as a cabinet or tunnel refers to having enough enclosure to allow the development of the desired degree of positive or negative pressure differential from ambient. Thus if no pressure differential is possible, an item is not substantially surrounded. Complete sealing is not necessary and in embodiments may not be desirable either.

A turret refers to a body having multiple spray guns mounted thereon, for example on spokes, projections, segments, sections, etc which are referred to herein as being "arms".

This listing of terms is not exhaustive nor exclusive.

The various diagrams and embodiments are discussed in detail.

Figure 4A:
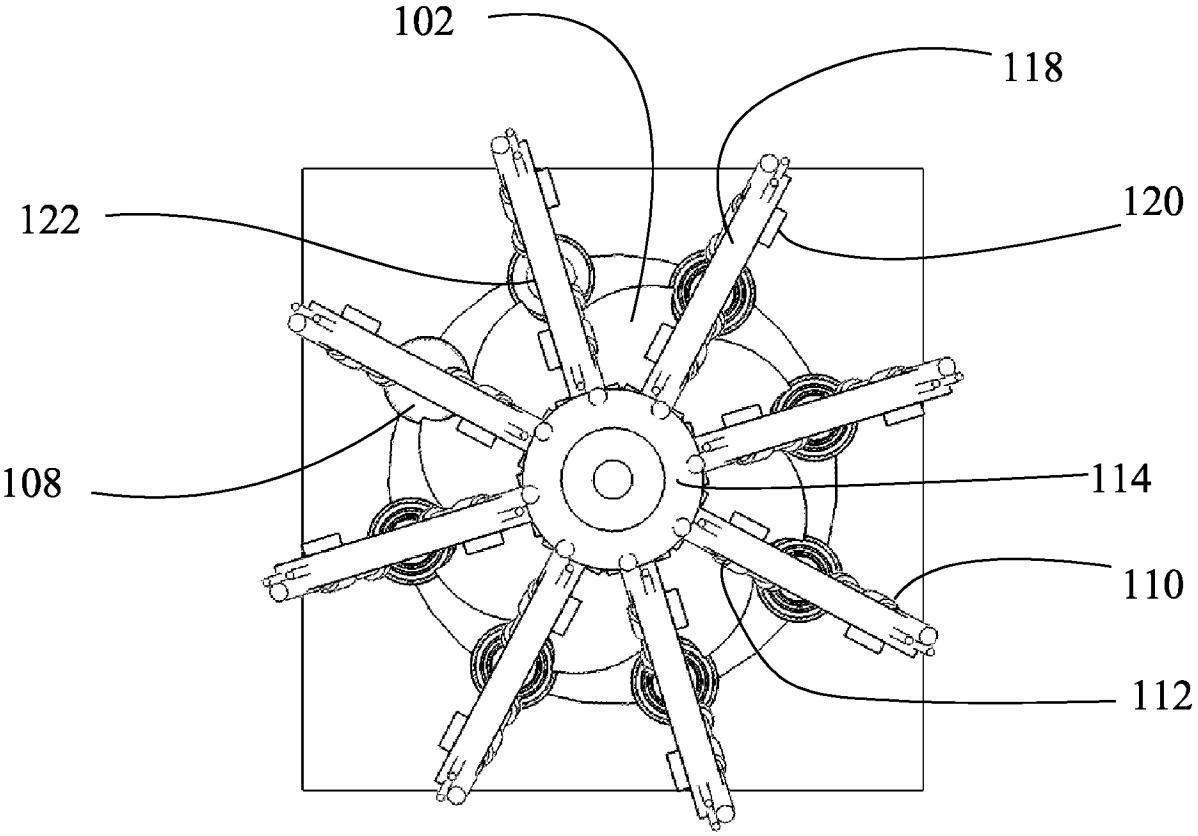
FIG. 4A is a top view of a first embodiment of the present invention, showing the star wheel and the spray gun turret having multiple spray guns mounted thereon.
Figure 4B:
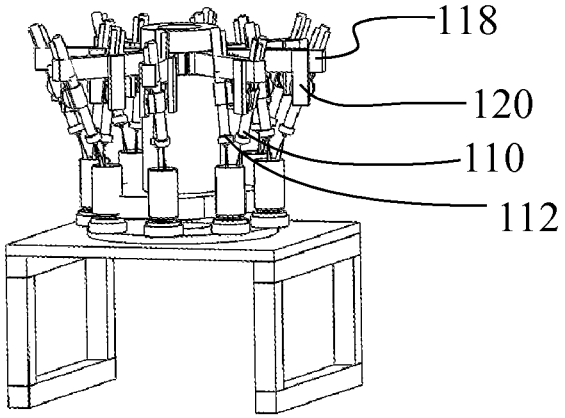
FIG. 4B is an isometric view of the first embodiment of the present invention, showing the star wheel and the spray gun turret.

FIG. 4A is a top view of a first embodiment of the present invention, showing the star wheel and the spray gun turret having multiple spray guns mounted thereon. FIG. 4B is an isometric view of the first embodiment of the present invention, showing the star wheel and the spray gun turret. Star wheel 102 may be seen, albeit somewhat obscured in both diagrams. (A better view of the star wheel may be had in reference to FIG. 11, discussed below.) Star wheel 102 has a number of pockets at the periphery. Below or within each pocket is a cooperating associated chuck 108. As the star wheel 102 rotates, chucks 108 rotate with it. Each chuck in turn has thereon vents 122 which allow the chuck to apply positive or negative air pressure to the bottom of a can or other cylindrical body riding upon the chuck. The chucks 108 may be customized to fit exactly the bottom contours of the cans/cylindrical bodies.

Chucks 108 may also spin. The rate of spin may be 2100 RPM, or may be significantly lower or higher. This spin is in relation to the pocket of the star wheel 102, so as the star wheel rotates, possible at a rate of perhaps 0 to 200 RPM, the chucks are carried along with it orbiting it at that same low speed while simultaneously spinning on their own axes at the much higher spin rate, which may be ten times or twenty times higher, or more. The obvious analogy is the Earth orbiting the sun once per year but spinning on its own axis once per day, that is, about 365 times as fast.

Above star wheel 102 is turret 114 having numerous projecting arms 118. Turret 114 also rotates with the star wheel 102. Each arm holds at least one and preferably two or more spray gun mounts 120 above each pocket. Thus the one or more spray guns 110/112 are associated with the pocket below: they rotate with the pocket and are thus stationary relative to the pocket. Each spray gun or nozzle may be any type of nozzle now known or later developed.

Figure 5:
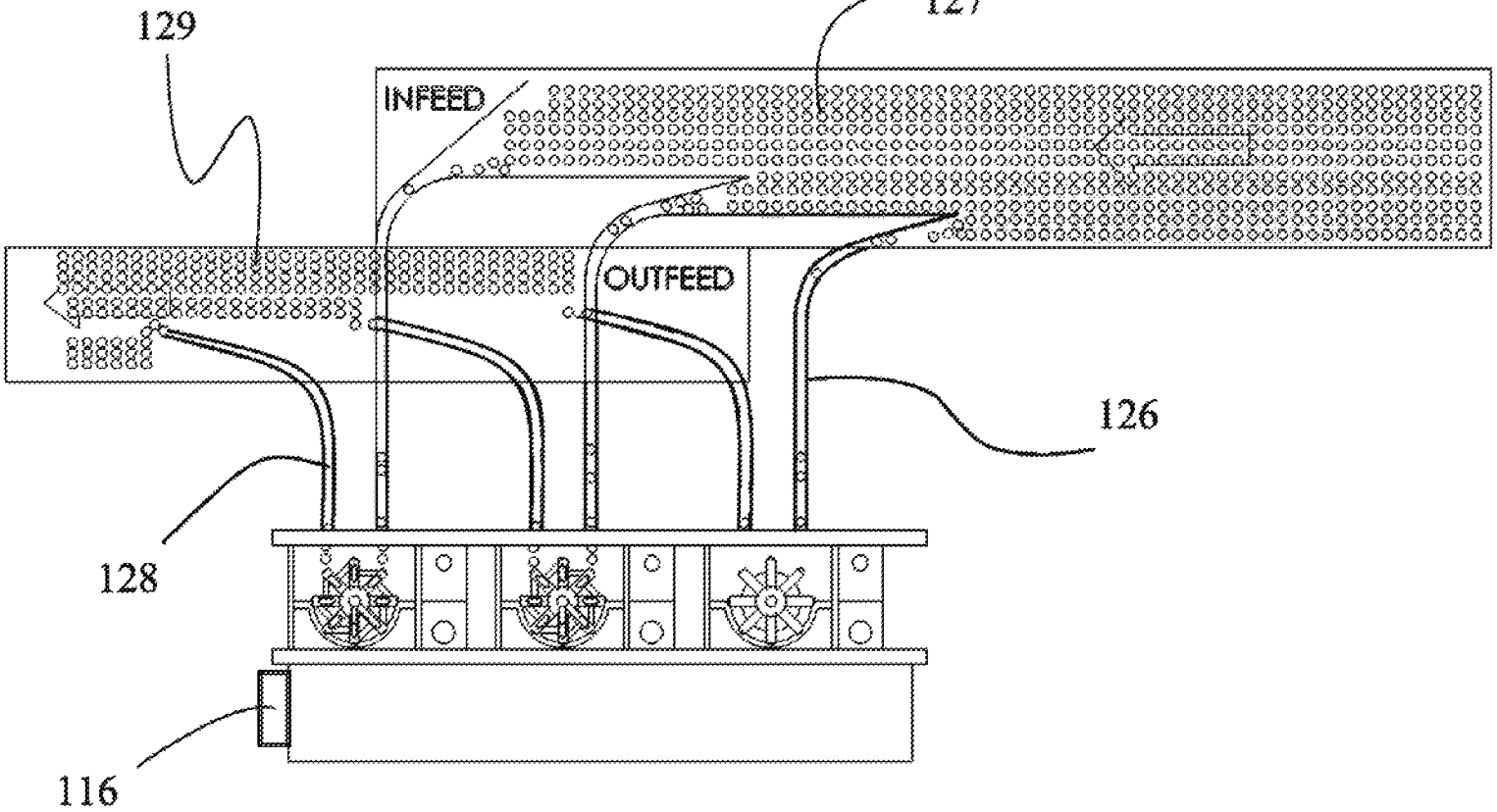
FIG. 5 is is a top view of a second embodiment of the present invention, showing the major layout and the star wheels and the spray gun turrets of multiple spray stations and further showing the infeed and outfeed conveyors for the spray stations of the invention.
Figure 6:
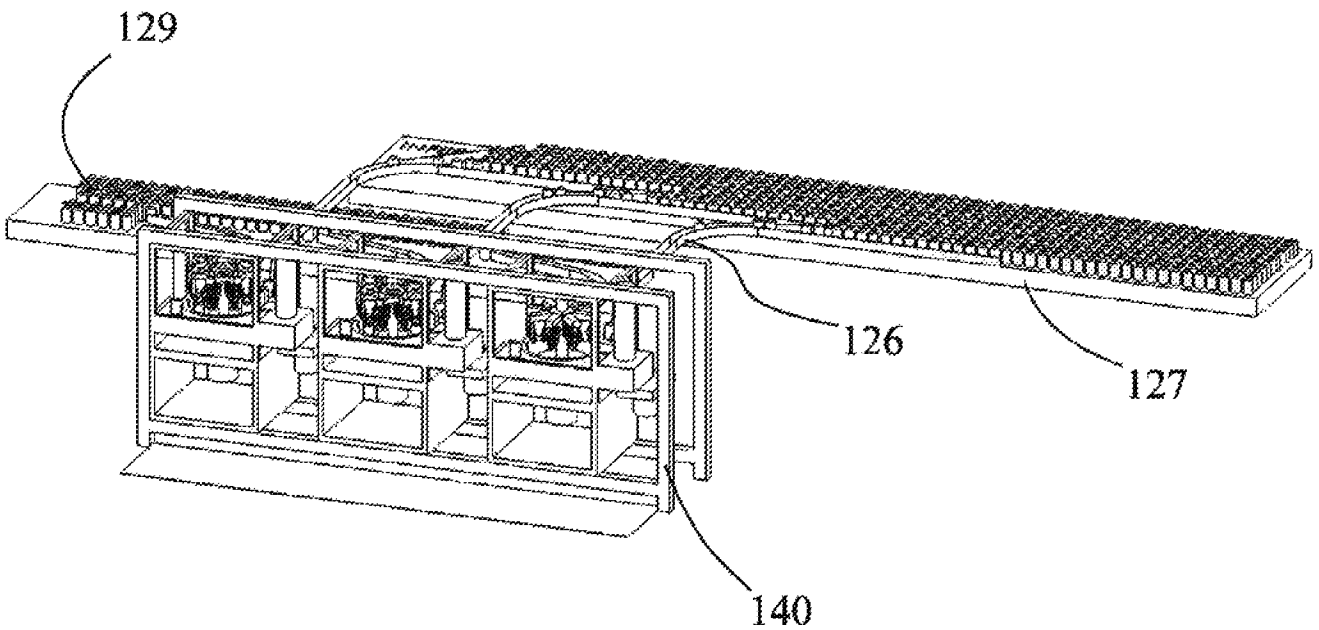
FIG. 6 is an isometric elevated oblique view of the second embodiment of the present invention, showing the major layout of the device and further showing the horizontal nature of the layout.

FIG. 5 is is a top view of a second embodiment of the present invention, showing the major layout and the star wheels and the spray gun turrets of multiple spray stations and further showing the infeed and outfeed conveyors for the spray stations of the invention. FIG. 6 is an isometric elevated oblique view of the second embodiment of the present invention, showing the major layout of the device and further showing the horizontal nature of the layout. Mass infeed 127 leads to the individual can infeed 126, on which cans travel in a column, that is, in single file, to reach the vertical can internal coating machine of the invention. Similarly outfeed 128 from teach machine may join mass outfeed 129. The infeeds and outfeeds may be conveyors of various types such as endless belts, walking floors, low friction races or slides, etc. FIG. 6 is particular shows the massive change in facility operations of the present invention: the cans are arriving and departing on the same level as the vertical can internal coating machine, rather than dropping from a height of 15 feet (4.5 m).

Controller 116 may be electronic or mechanical. As referenced elsewhere, it may control the time of spraying, the speed of rotation, the speed of chuck spin, the pressure, the aim of the gun mounts, the offset provided by the gun mounts, negative and positive pressure of the chucks and timing thereof, negative and positive pressure of the cabinet and tunnel and more. Since controller 116 and gun mounts 120 can be adjusted quickly and easily, and since chucks 108 may be replaced easily, the machine may alter its production details quite quickly.

Controller 116 may also sense, via sensors in the star wheel or chucks or elsewhere, whether or not a given pocket has a can or cylindrical body, either one, in it. If there is nothing in a pocket, spraying for that revolution of that pocket may be cancelled.

Figure 7A:
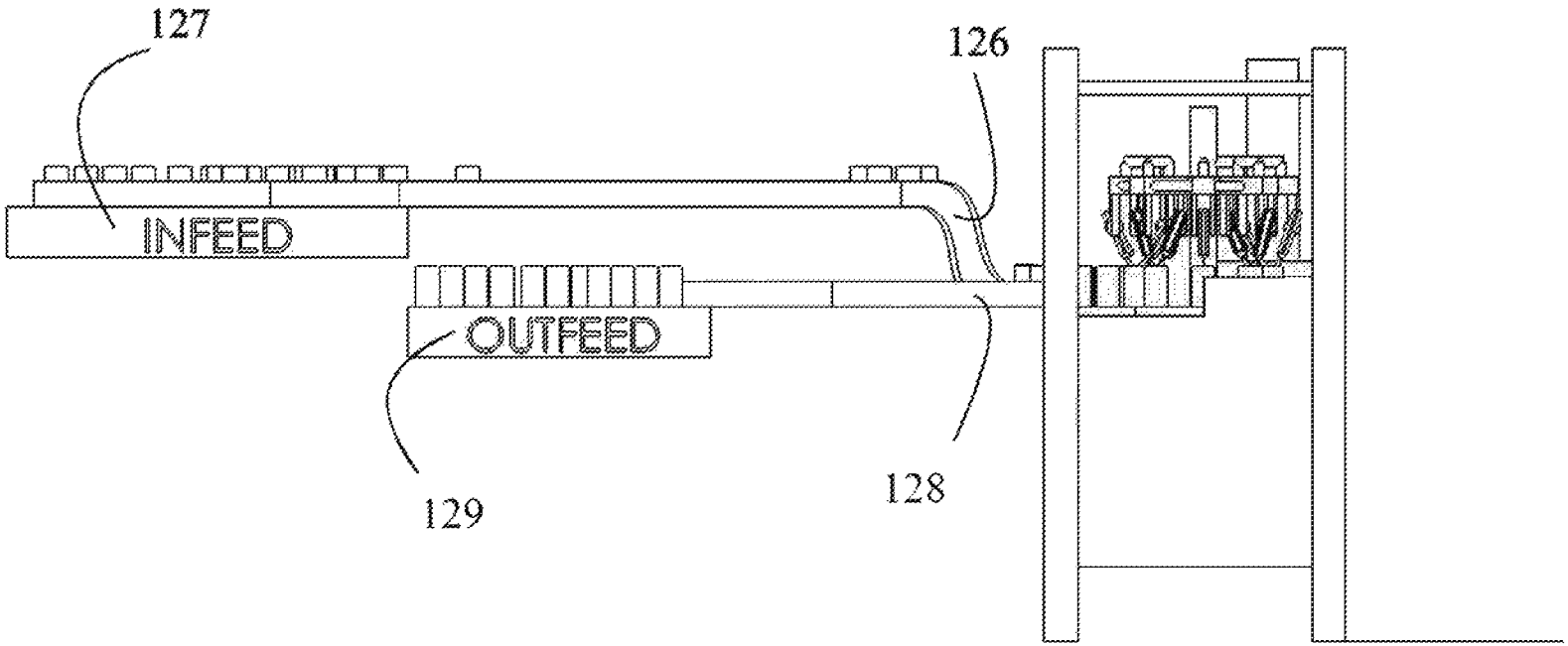
FIG. 7A is a left side view of the major layout of one alternative embodiment of the device, showing the vast simplification of the can coating line layout and the almost entirely horizontal nature of the layout, with only a small elevation change required for motion of the cans on the infeed.
Figure 7B:
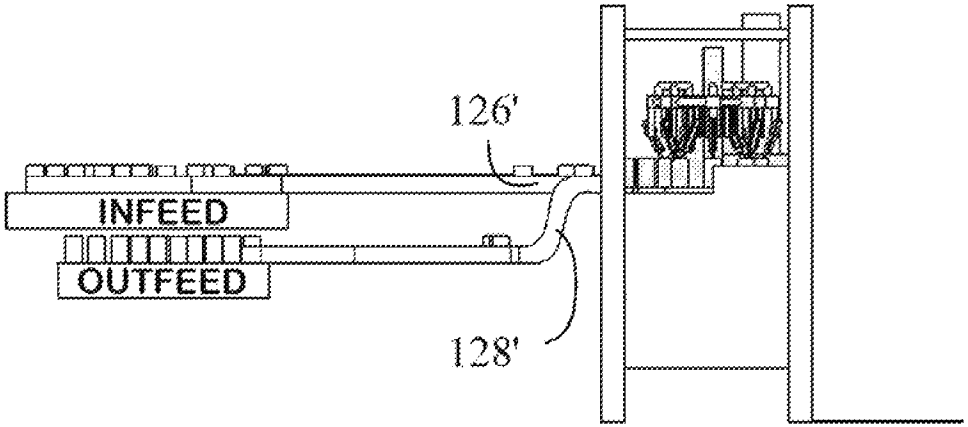
FIG. 7B is a left side view of the major layout of another alternative embodiment of the device, a horizontal infeed and small vertical drop on the outfeed instead.

FIG. 7A is a left side view of the major layout of one alternative embodiment of the device, showing the vast simplification of the can coating line layout and the almost entirely horizontal nature of the layout, with only a small elevation change required for motion of the cans on the infeed. FIG. 7B is a left side view of the major layout of another alternative embodiment of the device, a horizontal infeed and small vertical drop on the outfeed instead. Thus in FIG. 7A, the infeed 127 (mass) leads to the sloped infeed 126. It may have guard rails, races, it may be enclosed, etc. Outfeed 128 may then be level.

On the other hand, FIG. 7B shows the infeed 126' may be level and the outfeed 128' may be sloped. In other embodiments, both may be sloped, neither may be sloped, etc. The magnitude of the drop is also important: while in prior machines the cans descend from an actual upper story/mezzanine of the building, in the present machine even the optional modest drops are shown to be on the same level as the vertical can internal coating machine of the invention. These modest drops are generally less than 3 feet (0.9 m), and may facilitate the loading and unloading of cylindrical bodies from the machine.

One obvious assumption is that the vertical can internal coating machine of the invention will be located upon the ground floor or lower level of the facility. This assumption of course need not be true: the vertical can internal coating machine may be located on the upper level or mezzanine, which has advantages discussed below in relation to FIG. 3.

Figure 8:
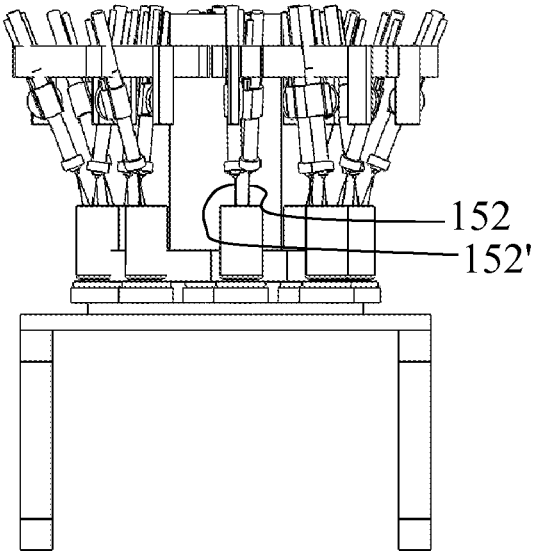
FIG. 8 is a front view of the machine in production, showing multiple guns spraying multiple cans at numerous index points of the star wheel, all simultaneously and continuously.

FIG. 8 is a front view of the machine in production, showing multiple guns spraying multiple cans at numerous index points of the star wheel, all simultaneously and continuously. Thus the can in the exact visual center of group of cans may be seen to be receiving internal coating from two spray guns simultaneously and thus has two sprays, 152 and 152' shown spraying down into it.

Figure 9:
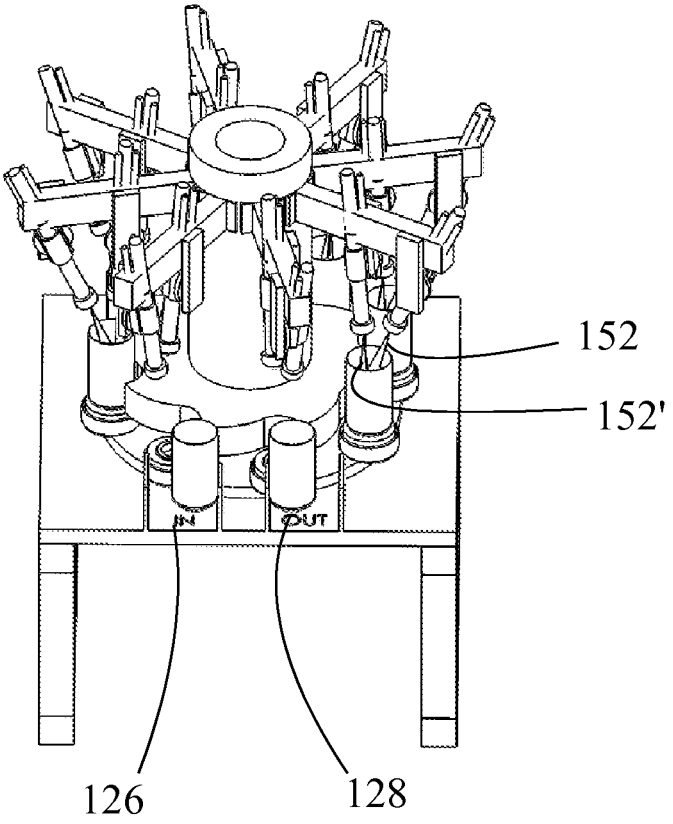
FIG. 9 is an oblique elevation view of the machine in production, showing the multiple guns spraying but adding the ends of the conveyors to the star wheel.

FIG. 9 also shows this: FIG. 9 is an oblique elevated horizontal view of the machine in production, showing the multiple guns spraying but adding the ends of the conveyors to the star wheel. Sprays 152 and 152' may be seen entering a can, the infeed and outfeed "stubs" or the ends of the infeed and outfeeds 126/128 may be seen where they contact the side of the machine's frame.

As shown in FIGS. 4B, 9, and others, the machine's frame may be palletized, that is, dimensioned and configured to allow the machine to be moved by means of a standard pallet jack, forklift or the like. This allows easy installation, removal and adjustment of the machines. This may be accomplished by providing a frame of sufficient strength and stability to support the machine and by providing near the bottom of the frame apertures as shown, which are dimensioned and configured to accept the tines of a fork lift, pallet jack or the like.

Figure 10:
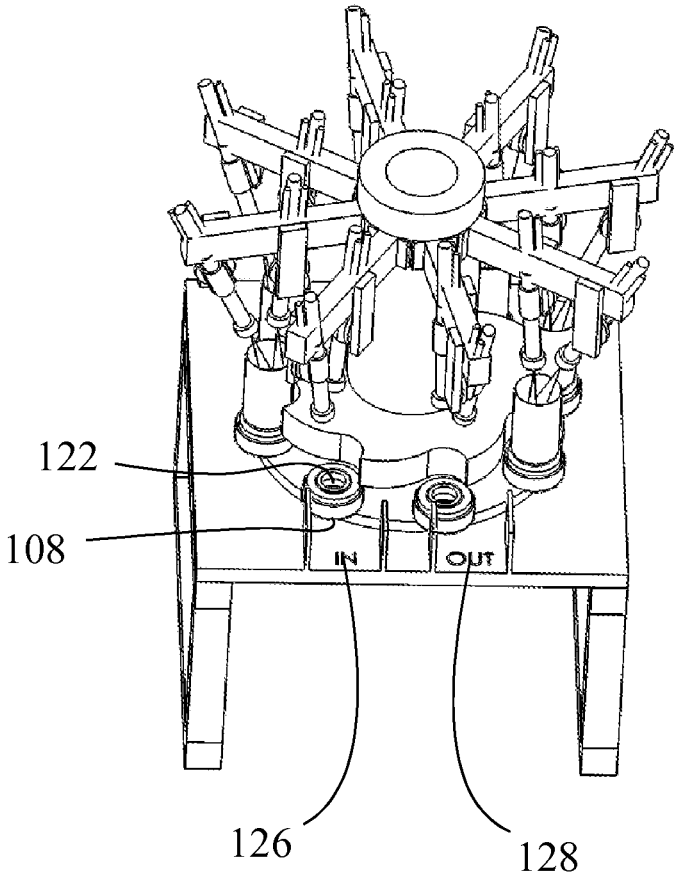
FIG. 10 is an elevated view of the machine in production, showing that spraying is occurring continuously at most index locations of the star wheel.

FIG. 10 is an elevated view of the machine in production, showing that spraying is occurring continuously at most index locations of the star wheel. Thus it can be seen that the spray guns are tuned off above the infeed and outfeed 126/128, but are spraying everywhere else as the cans make their way about the star wheel. The angle of this spraying may then be as much as 315 degrees, that is, everywhere except the gap between the in and out pockets/stubs/chucks. In practice the time of spraying, expressed in degrees or other angular measure (radians, pockets, etc) will be determined by the amount of time the spray guns require for complete spraying, by the speed of spin, the speed of rotation, number of guns, pressure, etc. All of these may be both sensed and controlled by the controller. The controller may be electronic or mechanical, for example in the preferred embodiment it may be a computer processor unit having programming thereon contained in non-volatile memory.

Figure 11:
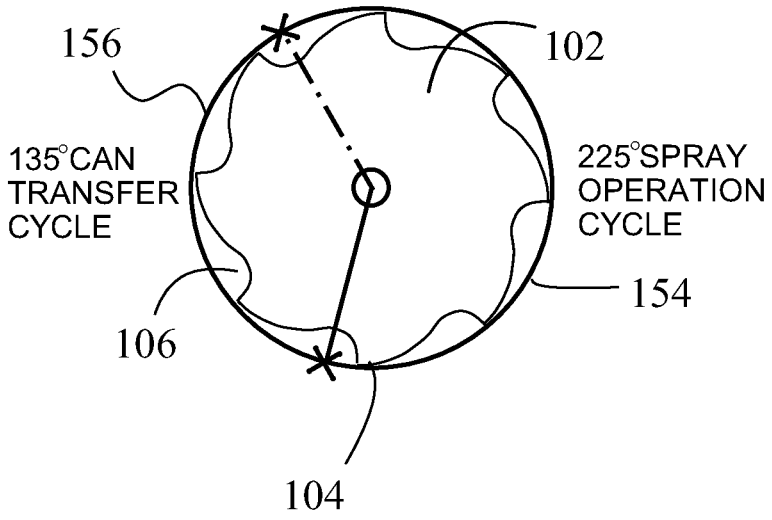
FIG. 11 is an EXEMPLARY top view of an eight-pocket star wheel only, with quadrants dividing up and showing the portion of the star wheel having cans in the pockets and the portions of the star wheel having spraying occurring.

FIG. 11 is an EXEMPLARY top view of an eight-pocket star wheel only, with quadrants dividing up and showing the portion of the star wheel having cans in the pockets and the portions of the star wheel having spraying occurring. Wheel 102 has periphery 104 defining pocket 106. Note that pocket 106 is depicted to be asymmetrical, which may be an advantage over older designs which could not rotate the wheel quickly and which constantly stopped, allowing cans time to drop in. However, the wheel may also have symmetrical pockets.

Exemplary arc 154 represents the time the spray cycle overall is employed. Within arc 154 a smaller arc may represent the actual time of spraying, as the spraying need not, and often beneficially will not, be done for the entire time the can is in the spray cycle area. For example, if the wheel takes 1 second to rotate and the exemplary spray cycle arc is 225 degrees, the pocket and contents will be in that zone for 0.625 second. However, if the spray product and desired properties call for only 100 milliseconds of spraying (0.1 second) then for most of the spray cycle the spray guns would not be active.

Arc 156 represents an exemplary can transfer cycle, in the example 135 degrees. As shown in earlier figures this might be less than that, for example two pockets only of a twelve pocket device would be only 30 degrees of arc. This part of the cycle represents the time the cans are loaded and unloaded.

Figure 12:
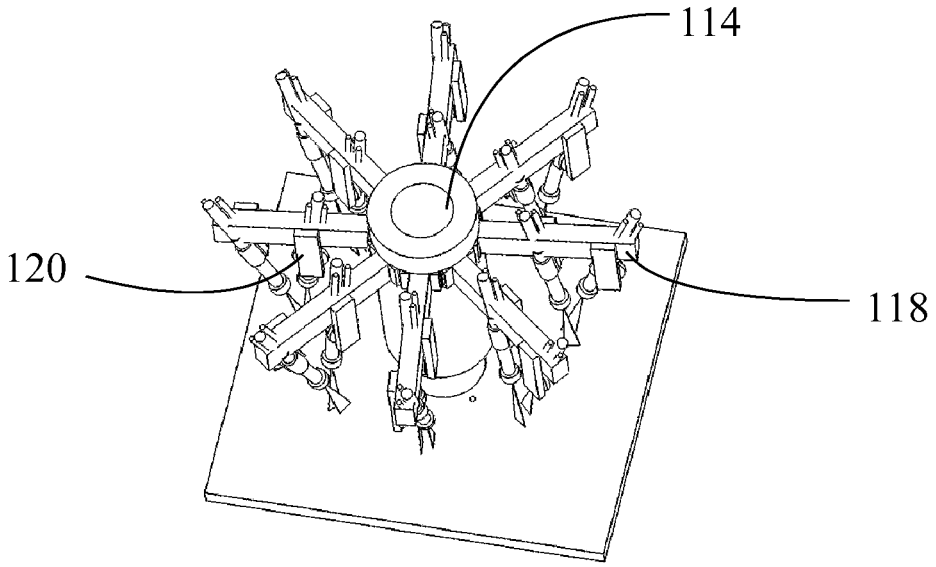
FIG. 12 is an exemplary oblique top view of a spray gun turret only, showing the multiple spray guns of the invention which enable the continuous spraying operation. This is provided for visualization convenience, to show the turret of the invention without the star wheel.

FIG. 12 is an exemplary oblique top view of a spray gun turret only, showing the multiple spray guns of the invention which enable the continuous spraying operation.

Turret 114 has arms 118 which in turn have mounts 120 thereon, carrying the spray guns 110/112. The number of arms may advantageously match the number of pockets, the length of the arms will depend on the size of the star wheel, the pockets, the cylindrical bodies, the orientation of the mounts, length and angle of the spray guns and so on. Turret 114 will rotate with the star wheel, so each spray gun/spray gun group maintains a constant position relative to the pocket underneath.

Figure 13:
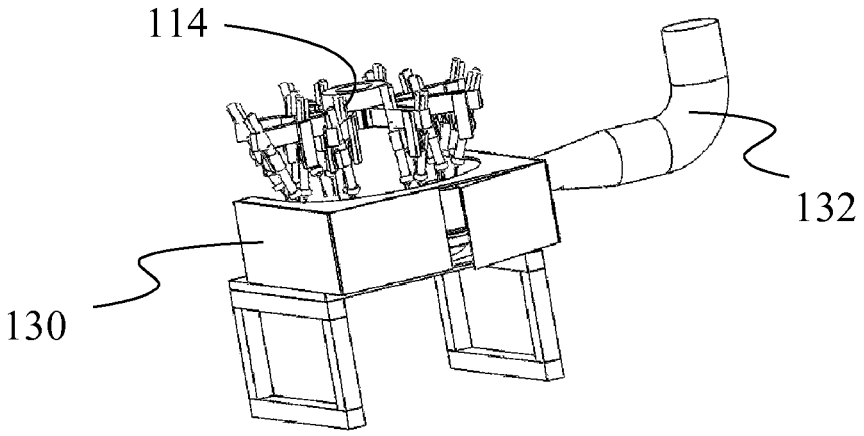
FIG. 13 is an oblique view of the invention with an alternative embodiment negative pressure cabinet and exhaust-air-to-fan duct. The turret above the star wheel is also plainly visible.

FIG. 13 is an oblique view of the invention with an alternative embodiment negative pressure cabinet and exhaust-air-to-fan duct. The turret above the star wheel is also plainly visible. As can be seen, the device is enclosed in a negative pressure cabinet or hood 130. In addition the dirty air duct 132 may be seen conveying away air with the entrained VOCs to a VOC destruction device such as the internal bake oven. By the use of these devices the VOC output of the production facility may be greatly reduced, with consequent great environmental benefits.

Figure 15:
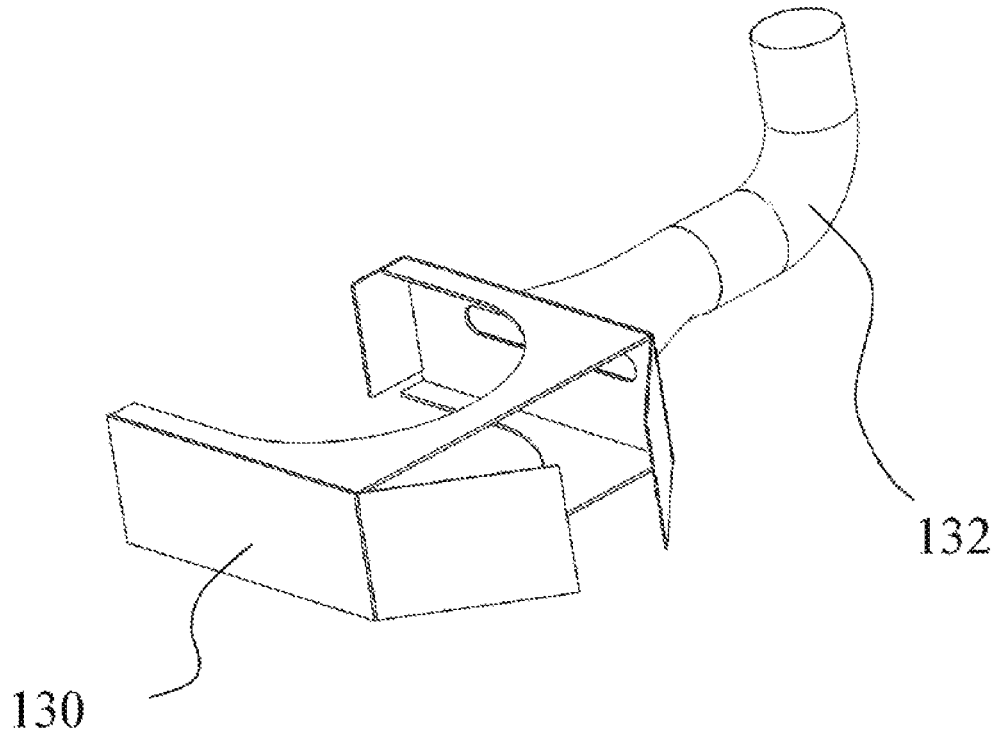
FIG. 15 is a view of a negative pressure cabinet and duct, with the vertical can sprayer machine removed for clarity.

FIG. 15 is a view of a negative pressure cabinet and duct, with the vertical can sprayer machine removed for clarity. The cabinet is a straightforward structure optionally having a way for air to enter (such as having no back side, no bottom, air intake vents or the like), a way for air with VOCs entrained to depart (duct 132), and preferably a connection to one of the VOC destruction machines, such as the internal bake oven.

Figure 16:
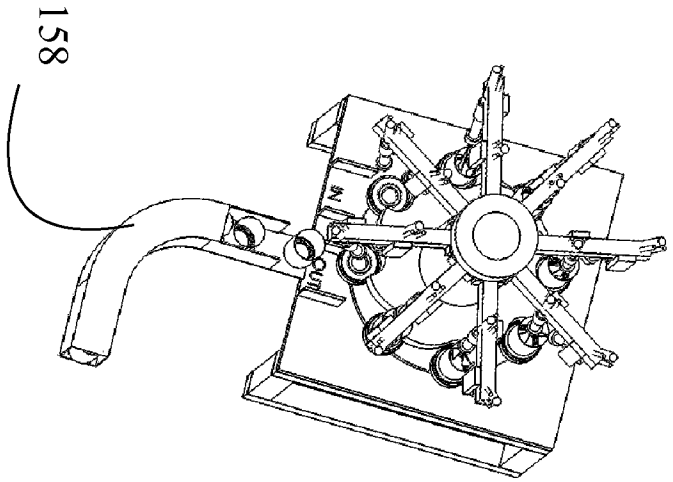
FIG. 16 is an elevated view of the machine with the positive pressure tunnel of the invention shown on the outfeed from the machine to the internal bake oven.

FIG. 16 is an elevated view of the machine with the positive pressure tunnel of the invention shown on the outfeed from the machine to the internal bake oven.

Positive pressure outfeed tunnel 158 may be seen curving away following the line of the outfeed conveyor and covering it so that VOCs emitted by the cans while in transit may be contained and may in due course reach a VOC destruction device, such as the internal bake oven to which the cans are bound in any case. Note that burning VOCs in the internal bake oven may not be possible for regulatory or other reasons, in which case the types of destruction machines listed previously may be employed.

Figure 17:
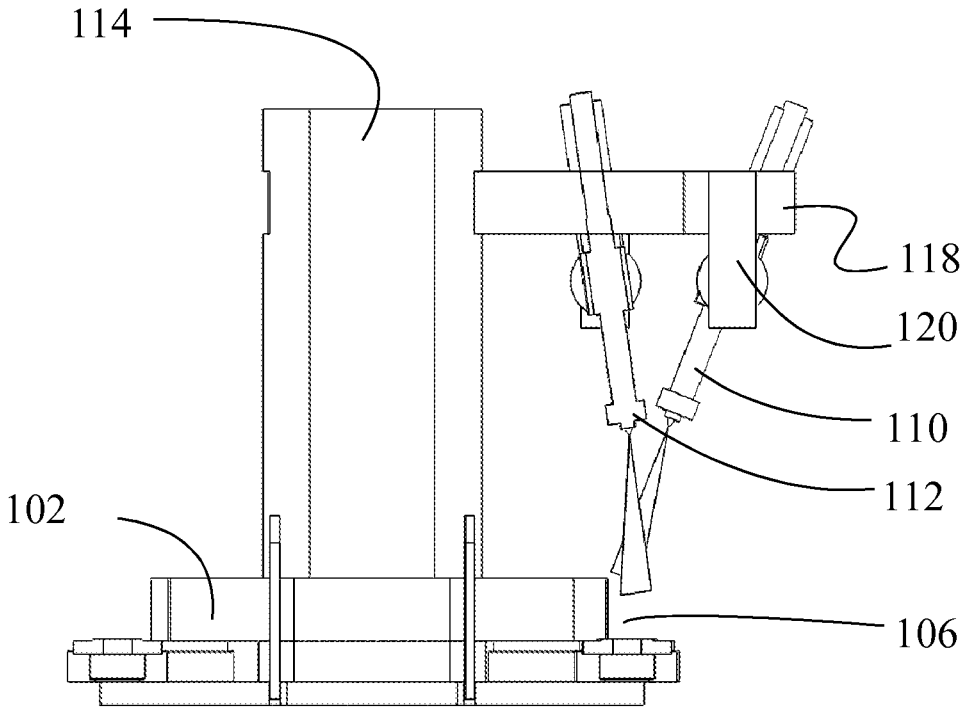
FIG. 17 is a cross-sectional view of the machine of the invention showing the star wheel and turret in cross-section.

FIG. 17 is a cross-sectional view of the machine of the invention showing the star wheel and turret in cross-section. In detail it may be seen that the star wheel 102 and the turret 114 may be physically connected, so that co-rotation and the association of an arm with a pocket may be provided. For clarity, one arm is omitted from this view while a coating is seen being sprayed.

Figure 18:
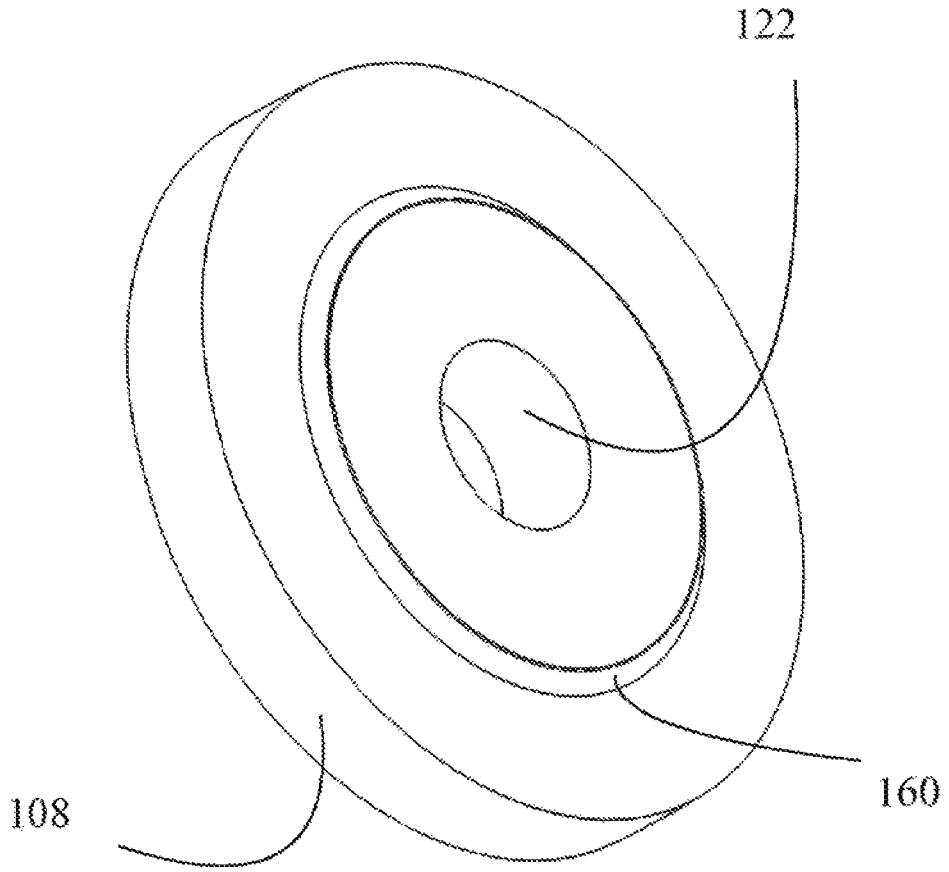
FIG. 18 is a view of an individual chuck, showing features which make it dimensioned and configured to accept a can bottom and also showing a positive/negative pressure vent through the chuck.

FIG. 18 is a view of an individual chuck, showing features which make it dimensioned and configured to accept a can bottom and also showing a positive/negative pressure vent 122 through the chuck.

Can securing device 160 may be the small ridge seen, which also accepts the can bottom. This device may be movable in operation, for example, it may widen slightly to grip a can (in this case, by the interior of the dome) or it may be a static structure. The positive/negative pressure vent 122 is of course also one alternative can securing device, as discussed elsewhere.

Figure 19:
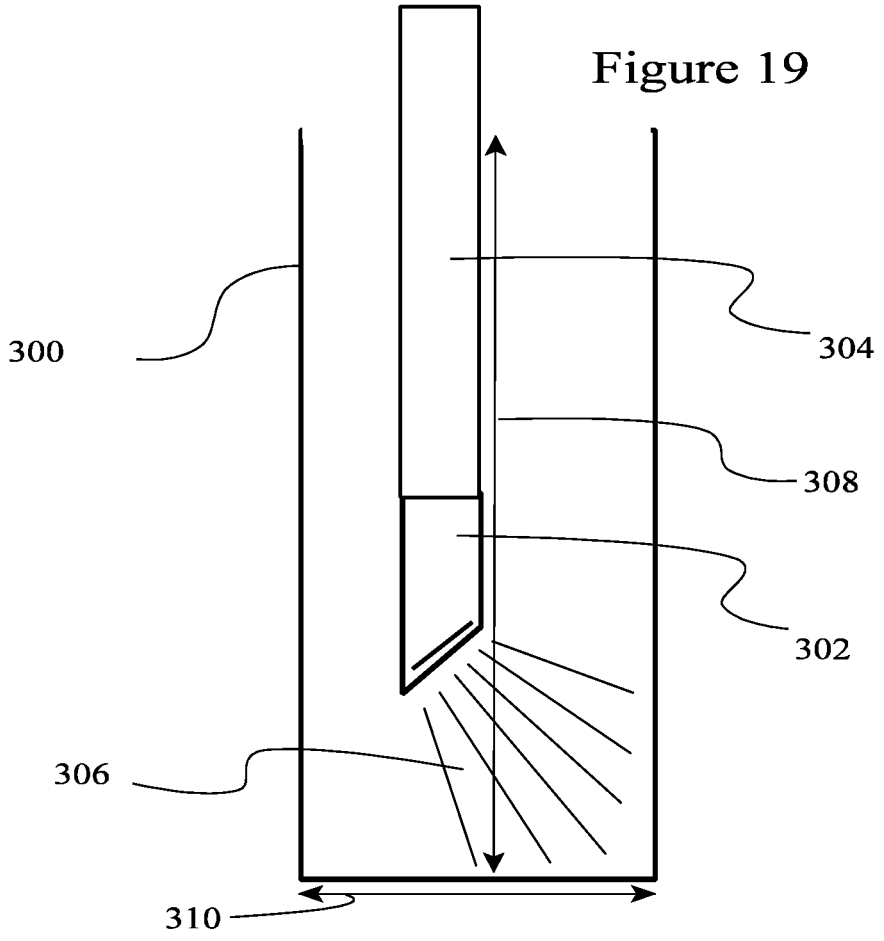
FIG. 19 is a cross sectional view of a hypothetical body having an different combination of axial length versus diameter, being somewhat taller, and showing that the lancing ability of a spray gun that may be employed with the present invention, instead of using a standard spray nozzle, as this may be required for the container shape.

FIG. 19 is a cross sectional view of a hypothetical body having an different combination of axial length versus diameter, being somewhat taller, and showing that the lancing ability of an extending spray gun may be employed with the present invention, instead of using a standard spray nozzle, if required by the shape of the container. Body 300 is much longer than the typical beverage can, for example it might be a cylindrical structural support requiring internal coating, or it might be a beverage can of unusual height, or a metal bottle, an aerosol can or monobloc container, etc. Regardless, it may be seen that axis 308 (used here as a measure of axial length) is long in comparison to diameter 310.

Normally, this would present a problem to a spray gun(s) situated only above and outside of the body 300. However, spray gun head 302 may extend on mount/spray gun extension 304, even extending into the body 300, as shown. In that location, the spray gun 302 may emit spray 306 while the body 300 rotates on a chuck (not shown). The entire interior surface may thus be coated properly. Note that the spray gun 302 may be offset or centered and may extend various distances into the can. While a single spray gun 302 is shown extended, multiple heads may advantageously be employed and extended as discussed and shown in the bulk of the present application.

As mentioned previously, the controller may allow quick changes from one type of body production to another type, as the controller may also control the degree of extension, number of heads extending, spray pattern and timing and so on during the interior spraying.

FIG. 14 is a tabular flowchart of the steps of the method of the invention.

The general steps of the invention have been laid out in the course of other discussions, summaries and so on. However, in brief, the first step of the method of the invention is the control by the controller 116 over various parameters, for example to modulate the star wheel speed, step 200. The speed of the star wheel and other parameters may vary from production task to production task.

Step 202 is to feed vertical cans to a coating machine having a continuously rotating horizontal star wheel having peripheral pockets thereon and an angular rotation speed.

Step 204 is to provide multiple offset spray guns per pocket. As noted elsewhere, the claims specify that a single gun per pocket may be used within the scope of the invention.

Rotate spray guns with star wheel, step 206, allows step 212 (below), the continuous spraying.

Secure cans in the pockets while the star wheel continues to rotate without stopping, using vacuum assist or other devices/methods, step 208. Vacuum assist may be optional, the geometry of the chucks and pockets and other structures may be sufficient to secure the cans.

Spin cans within pockets, step 210, as noted assists in providing an even complete coat. In alternative embodiments, the nozzles may rotate and the cans sit still.

Spray cans in the pockets while the star wheel continues to rotate without stopping, step 212, differentiates the invention from the older machines which only spray cans while they and the star wheel are stationary.

Remove cans from the pockets while the star wheel continues to rotate without stopping, optionally using air pressure assist or other methods, step 214, clears the pocket for the next can coming down the infeed.

Convey cans to an internal bake oven, step 216, is necessary as the coating is wet after spraying and must be baked to solidify.

Provide a negative pressure about the coating machine, entrain VOCs, send to internal bake oven or other VOC destruction device, step 218, is an aspect of the invention which allows greater environmental and safety metrics to be utilized.

Provide a positive pressure about outfeed, entrain VOCs, send to internal bake oven, step 220, serves the same function.

Figure 3:
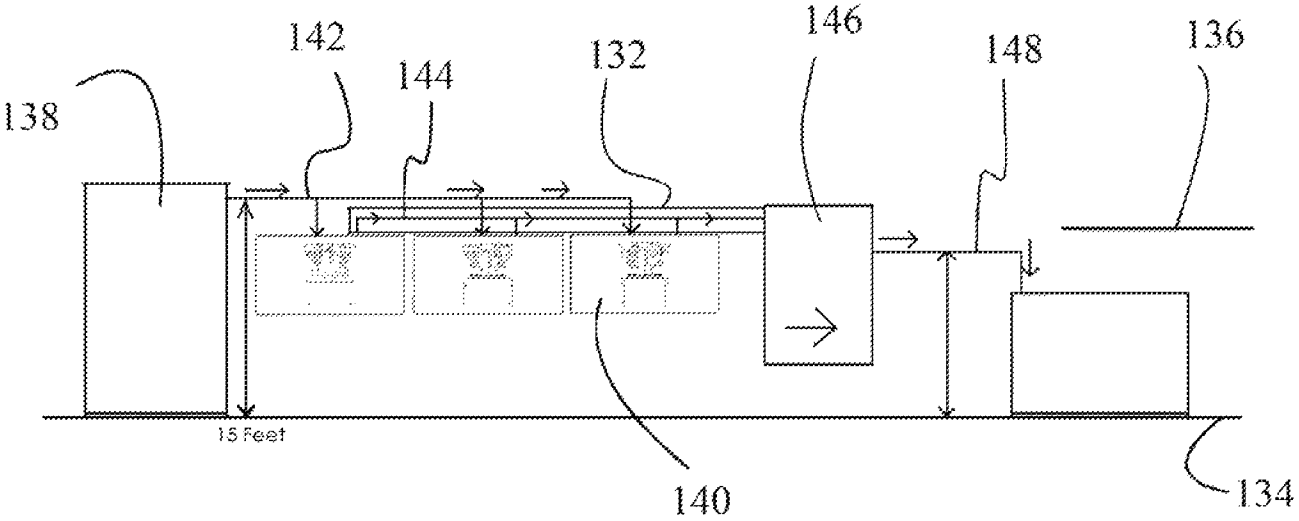
FIG. 3 is a side view schematic of a can coating line layout according to the present invention, showing the increase in flexibility of placement of the internal coating machine using the devices of the present invention. In this case the internal coating machine is located on a mezzanine level.

FIG. 3 is a side view schematic of a can coating line layout according to the present invention, showing the increase in flexibility of placement of the internal coating machine using the devices of the present invention. In this case the internal coating machine is located on a mezzanine level.

Figure 2:
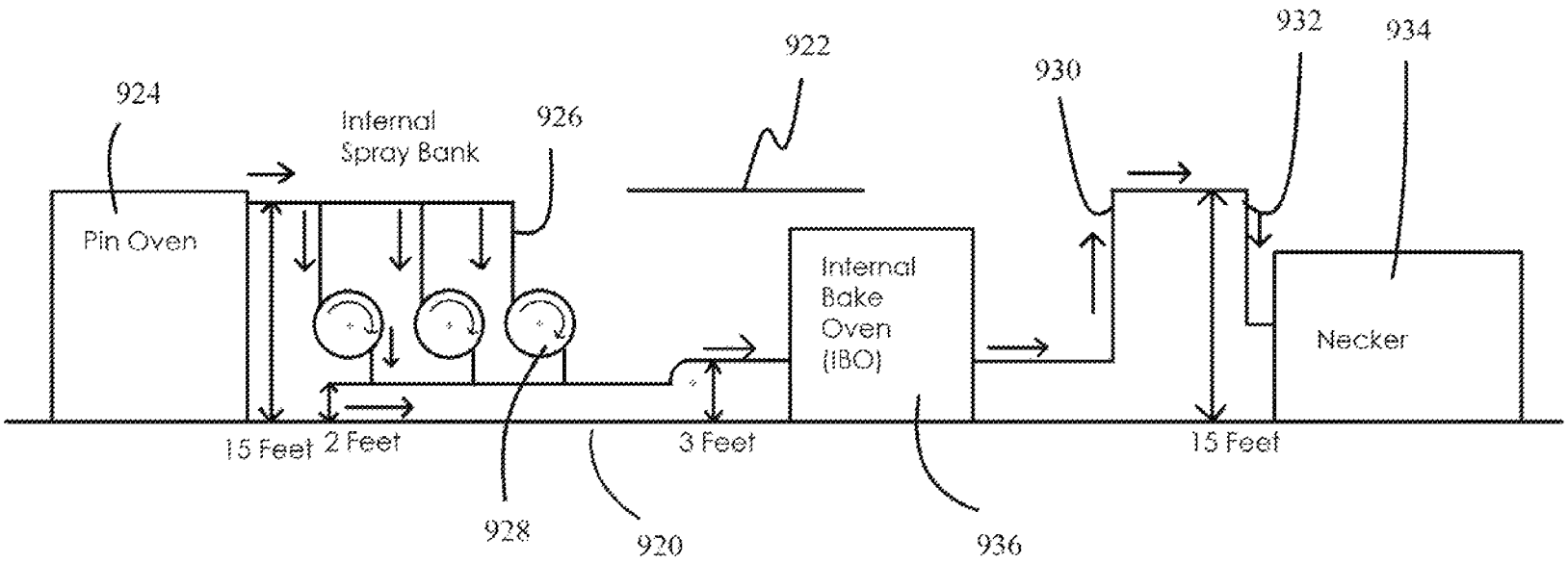
Figure 2 PRIOR ART
FIG. 2 is a side view schematic of a PRIOR ART can coating line layout, showing the number of times the cans are raised to a mezzanine or other elevated area during the coating process.

Lower level/ground level 134 is separated, perhaps by 15 feet (4.5 m) from the higher level/upper story/mezzanine level 136. Pin oven 138 lifts cans up to the upper level 136, after which they travel horizontally on a conveyor 142 (for example, mass infeed 126) to the vertical can internal coating machine bank 140. This is in contrast to PRIOR ART diagram FIG. 2, in which the coating machines are on a lower level. As the cans leave with the internal coating on conveyor 144 (for example, mass outfeed 128) they are within tunnel 132. They travel to internal bake oven 146, still on the upper level 136.

Conveyor 148 then allows the cans to descend to necker 150, as the necker 150 needs this descent. What is now missing is the vacuum conveyor which previously raised the cans above the necker 150: this item is no longer necessary at any point in the line. In addition, the descending conveyors previously used for the coating machines are eliminated. The line overall becomes more straight and the process of production and coating more straightforward. In addition, the process is now more flexible as components can now be placed on upper and lower levels with a reduced set of layout & machinery requirements.

Throughout this application, various publications, patents, and/or patent applications are referenced in order to more fully describe the state of the art to which this invention pertains. The disclosures of these publications, patents, and/or patent applications are herein incorporated by reference in their entireties, and for the subject matter for which they are specifically referenced in the same or a prior sentence, to the same extent as if each independent publication, patent, and/or patent application was specifically and individually indicated to be incorporated by reference.

Methods and components are described herein. However, methods and components similar or equivalent to those described herein can be also used to obtain variations of the present invention. The materials, articles, components, methods, and examples are illustrative only and not intended to be limiting.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art.

Having illustrated and described the principles of the invention in exemplary embodiments, it should be apparent to those skilled in the art that the described examples are illustrative embodiments and can be modified in arrangement and detail without departing from such principles. Techniques from any of the examples can be incorporated into one or more of any of the other examples. It is intended that the specification and examples be considered as exemplary only, with a true scope and spirit of the invention being indicated by the following claims.

What is claimed is:

1. A method of internally coating cans having an interior and an inner surface and an axis, the method consisting of the steps of:

feeding such cans to a coating machine having a continuously rotating star wheel having asymmetrical peripheral pockets thereon and an angular rotation speed, securing such cans in the pockets while the star wheel continues to rotate without stopping, spraying such cans in the pockets while the star wheel continues to rotate without stopping, removing such cans from the pockets while the star wheel continues to rotate without stopping, removing such cans from the coating machine;

providing a plurality of spray guns associated with each pocket, each one of the plurality of spray guns adjustably mounted to one of a plurality of arms;

rotating the adjustable mounts and arms at the angular rotation speed without stopping, whereby the spray guns adjustably mounted on the arms remain in alignment with the pockets as the star wheel and spray guns rotate;

rotating the star wheel in a horizontal plane and feeding, securing, spraying, removing and conveying such cans with such axes thereof vertically oriented;

modulating the star wheel and spray guns' rotation speed without stopping;

spinning such cans within such pockets at an angular spin speed, the angular spin speed being independent of the angular rotation speed.

2. The method of claim 1, further comprising:

rotating such cans at least 90 degrees about the star wheel between feeding such cans to the star wheel and removing such cans from the star wheel.

3. The method of claim 1, further comprising:

spraying such cans for at least 90 degrees of the rotation of the star wheel.

4. The method of claim 1, further comprising:

providing a device securing such cans in such pockets.

5. The method of claim 1, further comprising:

providing a device removing such cans from such pockets.

6. The method of claim 1, further comprising:

offsetting a first of the spray guns associated with a first pocket from a second of the spray guns associated with the first pocket, whereby the first and second spray guns spray two different parts of such inner surface of such can.

7. The method of claim 1, further comprising:

rotating the star wheel in a vertical plane and feeding, securing, spraying, removing and conveying such cans with such axes thereof horizontally oriented, and while the star wheel is in continuous motion.

8. The method of claim 1, wherein:

the star wheel comprises six or more pockets.

9. The method of claim 1, further comprising:

feeding such cans to the coating machine with their axes vertical on a horizontal infeed.

10. The method of claim 1, further comprising:

removing such cans from the coating machine with their axes vertical on a horizontal outfeed.

11. The method of claim 1, further comprising:

providing a negative pressure about the coating machine, whereby volatile organic compounds are entrained.

12. The method of claim 11, further comprising:

sending the volatile organic compounds to an internal bake oven.

13. The method of claim 12, further comprising:

providing a positive pressure while conveying such cans to the internal bake oven, whereby volatile organic compounds are entrained and sent to the internal bake oven.

14. The method of claim 1, further comprising:

extending into such interior of such cans at least one of the plurality of spray guns aligned with each star wheel while spraying.

15. The method of claim 1, further comprising:

providing a controller having operative control over the angular rotation speed and the spraying, the controller having a first mode in which it directs a first angular rotation speed and a first angular spin speed, the first angular spin speed being greater than the first angular rotation speed, and spraying to a first type of such can, the controller having a second mode in which it directs a second angular rotation speed and a second angular spin speed, the second angular spin speed being greater than the second angular rotation speed, and spraying a second type of such can.

* * * * *